US008596764B2

(12) United States Patent
Kida

(10) Patent No.: US 8,596,764 B2
(45) Date of Patent: Dec. 3, 2013

(54) IMAGE FORMING APPARATUS

(75) Inventor: Hitoshi Kida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 344 days.

(21) Appl. No.: 13/042,662

(22) Filed: Mar. 8, 2011

(65) Prior Publication Data

US 2011/0228006 A1 Sep. 22, 2011

(30) Foreign Application Priority Data

Mar. 16, 2010 (JP) ..... 2010-059019

(51) Int. Cl.
*B41J 2/06* (2006.01)
*B41J 29/393* (2006.01)
*B41J 2/04* (2006.01)

(52) U.S. Cl.
USPC ..... 347/55; 347/19; 347/54

(58) Field of Classification Search
None
See application file for complete search history.

(56) References Cited

U.S. PATENT DOCUMENTS

| | | | | |
|---|---|---|---|---|
| 6,086,190 | A | 7/2000 | Schantz et al. | |
| 2004/0207676 | A1 * | 10/2004 | Yamada et al. | 347/19 |
| 2009/0058921 | A1 | 3/2009 | Habashi | |

FOREIGN PATENT DOCUMENTS

| | | |
|---|---|---|
| JP | 11-170569 | 6/1999 |
| JP | 2004-284314 | 10/2004 |
| JP | 2005-238682 | 9/2005 |
| JP | 2006-272634 | 10/2006 |
| JP | 2007-21782 | 2/2007 |
| JP | 2009-78539 | 4/2009 |

* cited by examiner

*Primary Examiner* — Geoffrey Mruk
(74) *Attorney, Agent, or Firm* — Cooper & Dunham LLP

(57) ABSTRACT

An image forming apparatus that forms an image on a sheet by discharging a liquid droplet from a nozzle hole to the sheet, includes a voltage applying part that applies a voltage to an electrostatic attraction member to cause the electrostatic attraction member to attract the sheet, and acts as an electrically charging part that causes the liquid droplet to be electrically charged; and a checking part that detects an electrical charge or an induced electric current of the liquid droplet that has been electrically charged, for checking a state of the liquid droplet being discharged from the nozzle hole, wherein an electric potential applied by the voltage applying part is different between at a time when the liquid droplet is separating from the nozzle hole and at a time when the liquid droplet is flying.

5 Claims, 19 Drawing Sheets

IMAGE FORMING APPARATUS

BACKGROUND OF THE INVENTION

1. Field of the Invention

The present invention relates to an image forming apparatus such as an ink jet recording apparatus for which it is possible to determine a state of an ink droplet being discharged.

2. Description of the Related Art

An ink jet recording apparatus is known in which a pressure is caused to be generated in a liquid chamber, a liquid droplet is caused to discharge from a nozzle that is provided on the liquid chamber to a medium such as paper, and thus, printing is carried out on the medium. In particular, an ink jet recording apparatus of a so-called on-demand type is known in which many nozzles are arranged in an array, and, only when recording is carried out, a pressure is caused to be generated only in a liquid chamber corresponding to a desired one of the nozzles, and a liquid droplet is caused to be discharged by the nozzle. In the ink jet recording apparatus of the on-demand type, in a case where, for example, a standby time period in which recording is not carried out is long, it may become not possible to discharge ink droplets from the nozzles because a solvent of the ink existing in the nozzles evaporates and thus the viscosity of the ink increases, or because foreign materials or air bubbles exist in the ink. As a result, white lines, spots or such may occur in an image that the ink jet recording apparatus records and image quality may be thus degraded. Therefore, it may be necessary to check that liquid droplets can be properly discharged from the many nozzles arranged as mentioned above as a trial before actually carrying out printing, and carry out a recovery operation such as suctioning and ejecting the liquid from the nozzles which cannot discharge liquid droplets, and thus, it may be necessary that actual printing is carried out after almost all the nozzles become to be in states of being able to discharge liquid droplets.

As a method of thus determining whether ink droplets are discharged from nozzles, the following methods are known. A first method is such that liquid droplets to be discharged are caused to be electrically charged and an electrical charge flowing when the liquid droplets come into contact with a detection electrode is detected (see Patent Document 1 (Japanese Laid-Open Patent Application No. 2007-021782) and Patent Document 2 (Japanese Laid-Open Patent Application No. 11-170569)). A second method is such that liquid droplets to be discharged are caused to be electrically charged and an induced electric current that flows when the liquid droplets pass near a detection electrode is detected (see Patent Document 3 (Japanese Laid-Open Patent Application 2006-272634)). A third method is such that liquid droplets are caused to land between a pair of electrodes, and a change in resistance or dielectric constant between the electrodes is detected (see Patent Document 4 (Japanese Laid-Open Patent Application No. 2005-238682)).

Further, Patent Document 5 (Japanese Laid-Open Patent Application No. 2004-284314) discloses a liquid droplet discharge testing apparatus. The liquid droplet discharge testing apparatus is such that liquid droplets for testing are electrified and are caused to be discharged from nozzle holes, and the liquid droplets are deflected by means of a deflection electric field and are caused to land on a deflection electric field generating electrode and liquid droplet detecting member that is provided on a nozzle surface. As a result, an electric current flows through the deflection electric field generating electrode and liquid droplet detecting member, and it is determined as a result of the electric current being sensed that the liquid droplets have been discharged. This configuration requires a deflection electric field generating electrode per nozzle row on the nozzle surface, cleaning on the nozzle surface may thus become difficult, and also, it may be difficult to clean the deflection electric field generating electrode and liquid droplet detecting member that has become dirty by the liquid droplets having landed. Further, at a time of the testing, it is necessary that the liquid droplets for testing are discharged in such a condition that the speeds of the liquid droplets are made to be lower or the weights of the liquid droplets are made to be smaller so that flying directions of the liquid droplets can be greatly bent (deflected). Thus, complicated control may be required.

SUMMARY OF THE INVENTION

In consideration of the above-mentioned problem, according to an embodiment of the present invention, an image forming apparatus that carries out recording on a sheet by discharging a liquid droplet from a nozzle hole to the sheet includes a voltage applying part that applies a voltage to an electrostatic attraction member to cause the electrostatic attraction member to attract the sheet, and acts as an electrically charging part that causes the liquid droplet to be electrically charged; and a checking part that detects an electrical charge or an induced electric current of the liquid droplet that has been electrically charged for checking a state of the liquid droplet being discharged from the nozzle hole. In this configuration, an electric potential applied by the voltage applying part is caused to be different between at a time when the liquid droplet is separating from the nozzle hole and at a time when the liquid droplet is flying.

Other objects, features and advantages of the present invention will become more apparent from the following detailed description when read in conjunction with the accompanying drawings.

BRIEF DESCRIPTION OF THE DRAWINGS

FIG. 6 (*b*) shows a waveform of a liquid droplet control signal during the states (1) through (6); and FIG. 6 (*c*) shows a waveform of an electric potential of the electrostatic attraction plate with respect to an electric potential of a nozzle surface of an ink jet head during the states (1) through (6), according to the first embodiment;

FIG. 9 (*b*) shows a waveform of the liquid droplet control signal during the states (1) through (6); and FIG. 9 (*c*) shows a waveform of the electric potential of the electrostatic attraction plate with respect to the electric potential of the nozzle surface of the ink jet head during the states (1) through (6), according to the second embodiment (belonging to the first mode for carrying out the present invention);

FIG. 11A (*b*) shows a waveform of the liquid droplet control signal during the states (1) through (6); and FIG. 11A (*c*) shows a waveform of the electric potential of the electrostatic attraction plate with respect to the electric potential of the nozzle surface of the ink jet head, according to the third embodiment (belonging to the first mode for carrying out the present invention);

FIG. 11B (*b*) shows a waveform of the liquid droplet control signal during the states (1) through (6); and FIG. 11B (*c*) shows a waveform of the electric potential of the electrostatic attraction plate with respect to the electric potential of the nozzle surface of the ink jet head, according to another example of the third embodiment (belonging to the first mode for carrying out the present invention);

DETAILED DESCRIPTION OF THE EMBODIMENTS

Embodiments of the present invention have been devised for the purpose of solving the above-mentioned problems in the related arts, and an object of the embodiments is to provide an image forming apparatus for which it is possible to check a state of an ink droplet (i.e., liquid droplet) being discharged from a nozzle and in which it is not necessary to newly provide, for the purpose of the nozzle discharge check operation, electrodes and/or high voltage generating source for causing the liquid droplet to be electrically charged. According to the embodiments, by using the existing parts/components of the image forming apparatus, a liquid droplet as an electrified body is used; and the discharging of the liquid droplet is electrically measured to be able to check whether the liquid droplet has been positively discharged from the nozzle. Furthermore, it is possible to bend a track of the liquid droplet in the nozzle discharge check operation.

Thus, in the image forming apparatus according to the embodiments of the present invention, it is possible to bend the flying direction of the liquid droplet having been electrically charged to a direction of going away from an electrostatic attraction member, and thus, it is possible to prevent the electrostatic attraction member from being stained with the liquid droplet.

Further, an ink jet head is moved to a discharge check position only when discharging of the liquid droplet is checked (i.e., at the time of the nozzle discharge check operation). Therefore, it is possible to prevent the nozzle from being dried, as a result of the ink jet head being moved to a home position when printing is not carried out (i.e., in a standby state) and the nozzle being capped. Thereby, it is possible to obtain a stable recorded image, and also, a margin of design when a configuration for the nozzle discharge check operation is mounted in the image forming apparatus can be increased.

Figure 1:
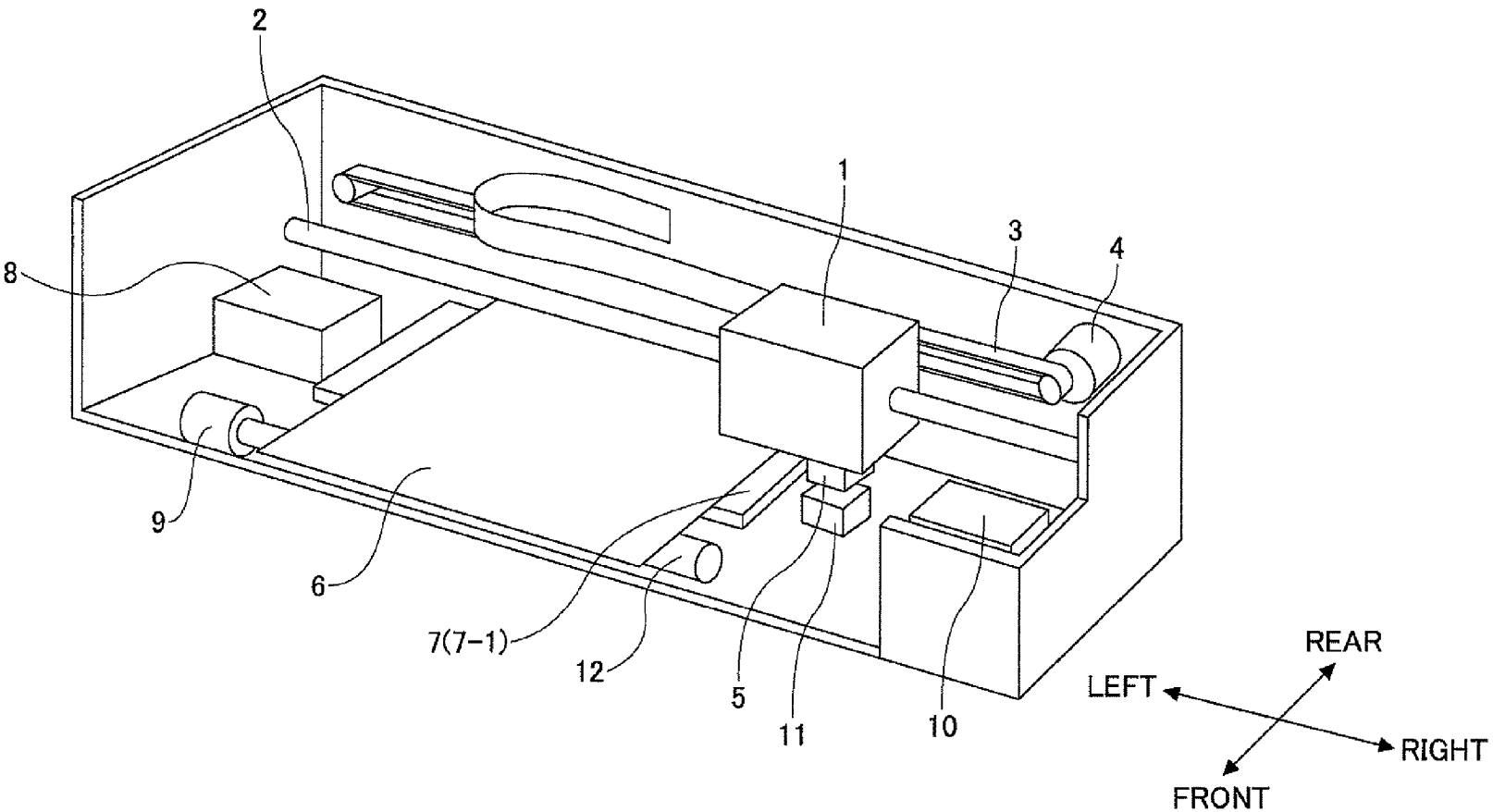
FIG. 1 shows a perspective view of a partial configuration of an image forming apparatus of ink jet type (i.e., an ink jet recording apparatus) according a first mode for carrying out the present invention.

FIG. 1 shows an ink jet recording apparatus (which is one example of an image forming apparatus) according to a first mode for carrying out the present invention. A carriage 1 is provided in the ink jet recording apparatus, and a configuration is provided in the inside of the ink jet recording apparatus such that the carriage 1 can move left and right directions (LEFT and RIGHT in FIG. 1) along a supporting bar 2. The carriage 1 is connected with a belt 3, and the belt 3 is connected with a motor 4. As the motor 4 rotates, the belt 3 moves in the left and right directions, and thereby, the carriage 1 is moved in the left and right directions as mentioned above. A nozzle plate (not shown) is provided in the carriage 1, and the nozzle plate moves in the left and right directions along with the movement of the carriage 1. The nozzle plate has an ink jet head 5 that includes many nozzles (not shown) that are disposed to form plural rows.

Further, in the ink jet recording apparatus, an electrostatic attraction plate 7-1 as the electrostatic attraction member 7 which attracts a sheet recording medium 6 on which an image is to be recorded; and a paper feeding roller 12, are provided. To the electrostatic attraction plate 7-1, an alternate current voltage of hundreds through thousands of volts which varies between positive and negative voltages is applied by a high voltage generating source 8 to generate electrostatic force. The electrostatic attraction plate 7-1 conveys the sheet recording medium 6 in a forward direction (FRONT in FIG. 1) as the motor 9 moves the paper feeding roller 12 while the electrostatic attraction plate 7-1 attracts the sheet recording medium 6 by means of the electrostatic force. The voltage applied by the high voltage generating source 8 to the electrostatic attraction plate 7-1 is controlled by the control part 100 (see FIG. 17).

Liquid droplets are caused to be discharged from the ink jet head 5 toward the sheet recording medium 6 according to image data sent from the control part 100 as the carriage 1 is moved in the left direction, and the sheet recording medium 6 is moved in the forward direction by a predetermined distance. After that, liquid droplets are caused to be discharged from the ink jet head 5 toward the sheet recording medium 6 according to image data sent from the control part as, at this time, the carriage 1 is moved in the right direction. By repeating the operations, a desired image is formed (recorded) on the sheet recording medium 6.

The carriage 1 stands by on a maintenance apparatus 10 when printing is not carried out. On the maintenance apparatus 10, ink is suctioned from the ink jet head 5; nozzles that cannot discharge ink are restored to be able to discharge ink; and the nozzles are sealed as a result of the ink jet head 5 being covered so that ink in the nozzles can be effectively prevented from being dried and becoming not being able to discharge ink. The position of the maintenance apparatus 10 is referred to as the home position.

Further, in the ink jet recording apparatus (such as an ink jet printer), a detecting part 11 for detecting the liquid droplet is provided near and to the right side of the electrostatic attraction member, i.e., the electrostatic attraction plate 7-1. The ink jet head 5 can be positioned on the detecting part 11 by a mechanism including the carriage 1, the supporting bar 2, the belt 3 and the motor 4, and the position of the detecting part 11 is referred to as the discharge check position (details will be described later). The detecting part 11 has a liquid droplet detecting electrode 11-1 (or 302) (shown in FIGS. 4, 5 and 6).

When printing is not carried out, the ink jet head 5 stands by at the home position (in the standby state), and is moved to the discharge check position when discharging of liquid droplets is to be checked (i.e., the nozzle discharge check operation is to be carried out).

The ink jet recording apparatus according to the embodiments of the present invention automatically carries out a nozzle discharge check operation and a maintenance operation.

Figure 2:
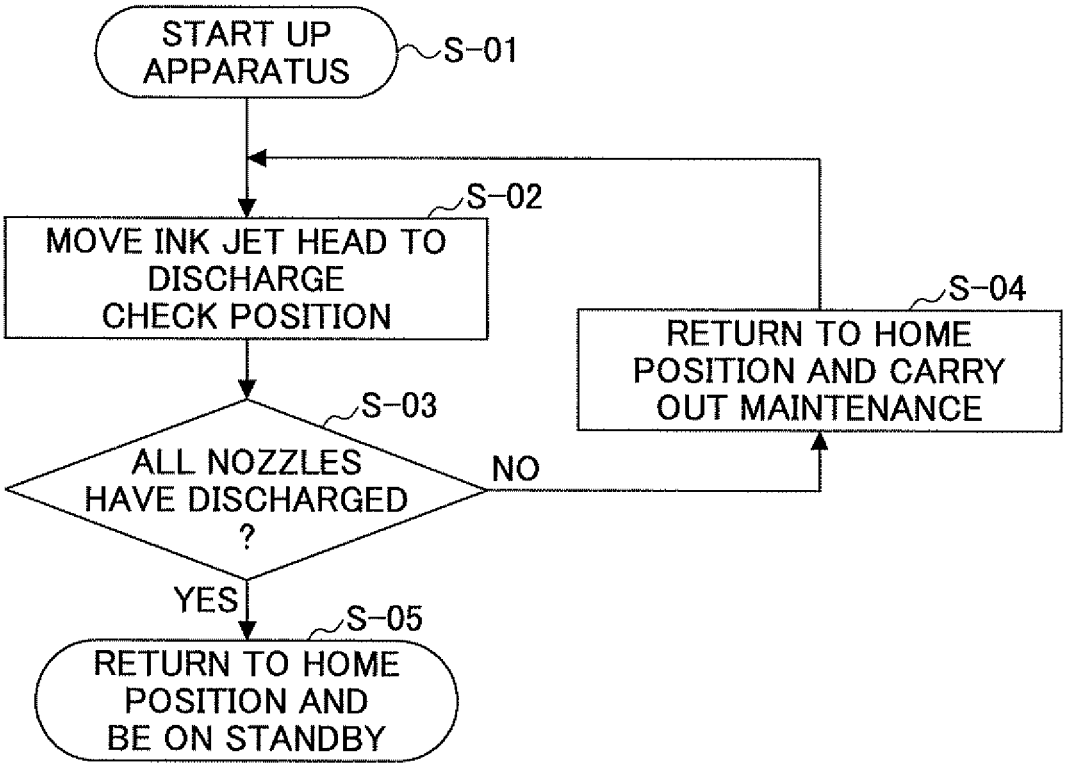
FIG. 2 shows a flowchart showing an operation flow in the image forming apparatus of ink jet type according to any one of the first and second modes for carrying out the present invention.
Figure 3:
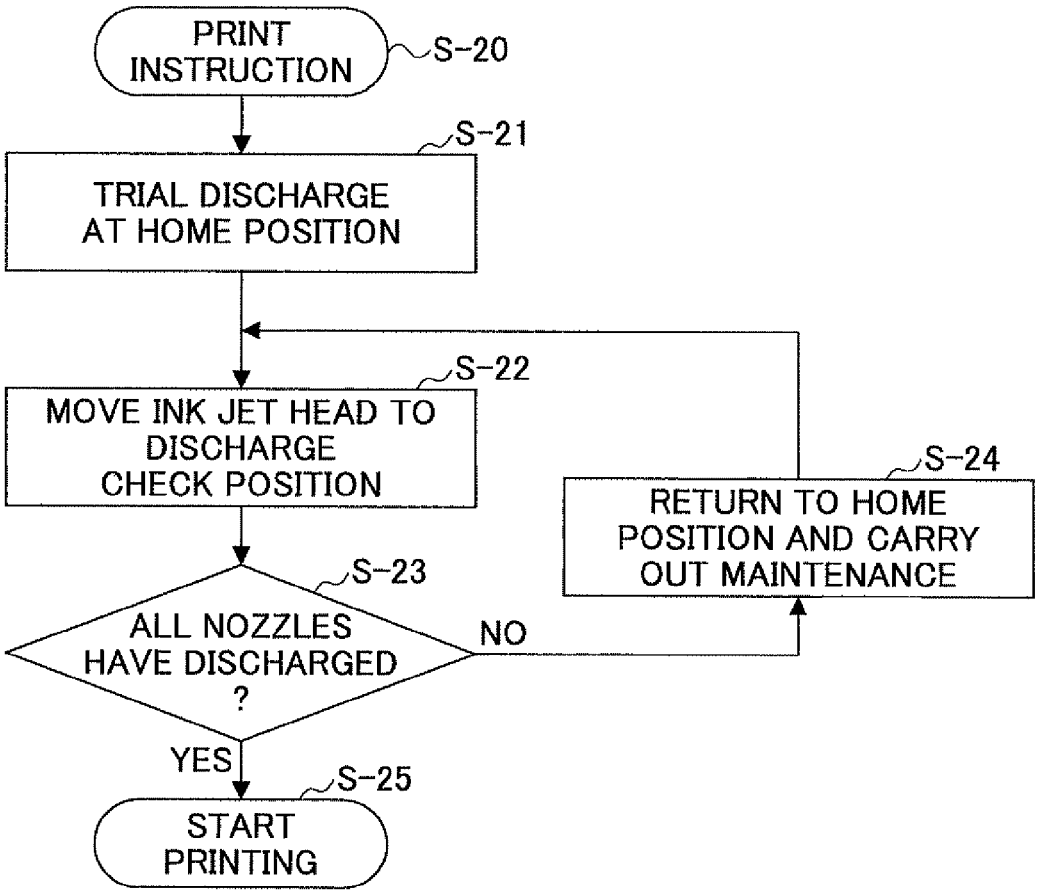
FIG. 3 shows a flowchart showing an operation flow in the image forming apparatus of ink jet type according to any one of the first and second modes for carrying out the present invention in which after a predetermined time period has elapsed or printing has been carried out on a predetermined number of sheets after the image forming apparatus was started up, a nozzle discharge check operation and a maintenance operation are carried out automatically.

In the ink jet recording apparatus according to the embodiments of the present invention, under the control of the control part 100 (see FIG. 17), as shown in the flowchart of FIG. 2, the ink jet head 5 is moved from the home position to the discharge check position in step S-02 when the ink jet recording apparatus has been started up in step S-01. Then, the nozzle discharge check operation is carried out in step S-03. Then, when it has been determined through the nozzle discharge check operation that there are nozzles included in the ink jet head 5 which have not discharged liquid droplets (step S-03 NO), the ink jet head 5 is returned to the home position, the maintenance operation such as a purge operation or such is carried out (step S-04), the ink jet head 5 is then moved to the discharge check position (step S-02), and the nozzle discharge check operation is carried out again (step S-03). Then, after it is confirmed that all the nozzles of the ink jet head 5 have discharged liquid droplets (step S-03 YES), the ink jet head 5 is retuned to the home position (step S-05), and thus, printing can be started. Further, the ink jet recording apparatus has a timer (not shown) or a counter (not shown) that counts the number of sheets having been printed (recorded). In the ink jet recording apparatus, as shown in a flowchart of FIG. 3, under the control of the control part 100, when a long time period has elapsed detected by the timer or many sheets have been printed counted by the counter after the ink jet recording apparatus was started up, in response to a printing instruction from the standby state of step S-05 of FIG. 2 (step S-20), a trial discharge operation) may preferably be carried out at the home position (step S-21). In the trial discharge operation, ink is discharged from the ink jet head 5, which does not contribute to image forming (printing) on the sheet recording medium 6. Then, the ink jet head 5 is moved to the discharge check position (step S-22). That is, the procedure is carried out as steps S-20→S-22, and preferably, S-20→S-21→S-22. Then, the nozzle discharge check operation is carried out in step S-23. Then, when there are nozzles included in the ink jet head 5 which have not discharged liquid droplets (step S-23 NO), the ink jet head 5 is returned to the home position, the maintenance operation such as the purge operation or such is carried out (step S-24), the ink jet head 5 is then moved to the discharge check position (step S-22) and the nozzle discharge check operation is carried out again (step S-23). Then, after it is confirmed that all the nozzles of the ink jet head 5 have discharged liquid droplets (step S-23 YES), the ink jet head 5 is retuned to the home position, and printing is started according to the printing instruction given in step S-20 (step S-25).

First Embodiment

First Operation Example in First Mode for Carrying Out the Intention

Figure 4:
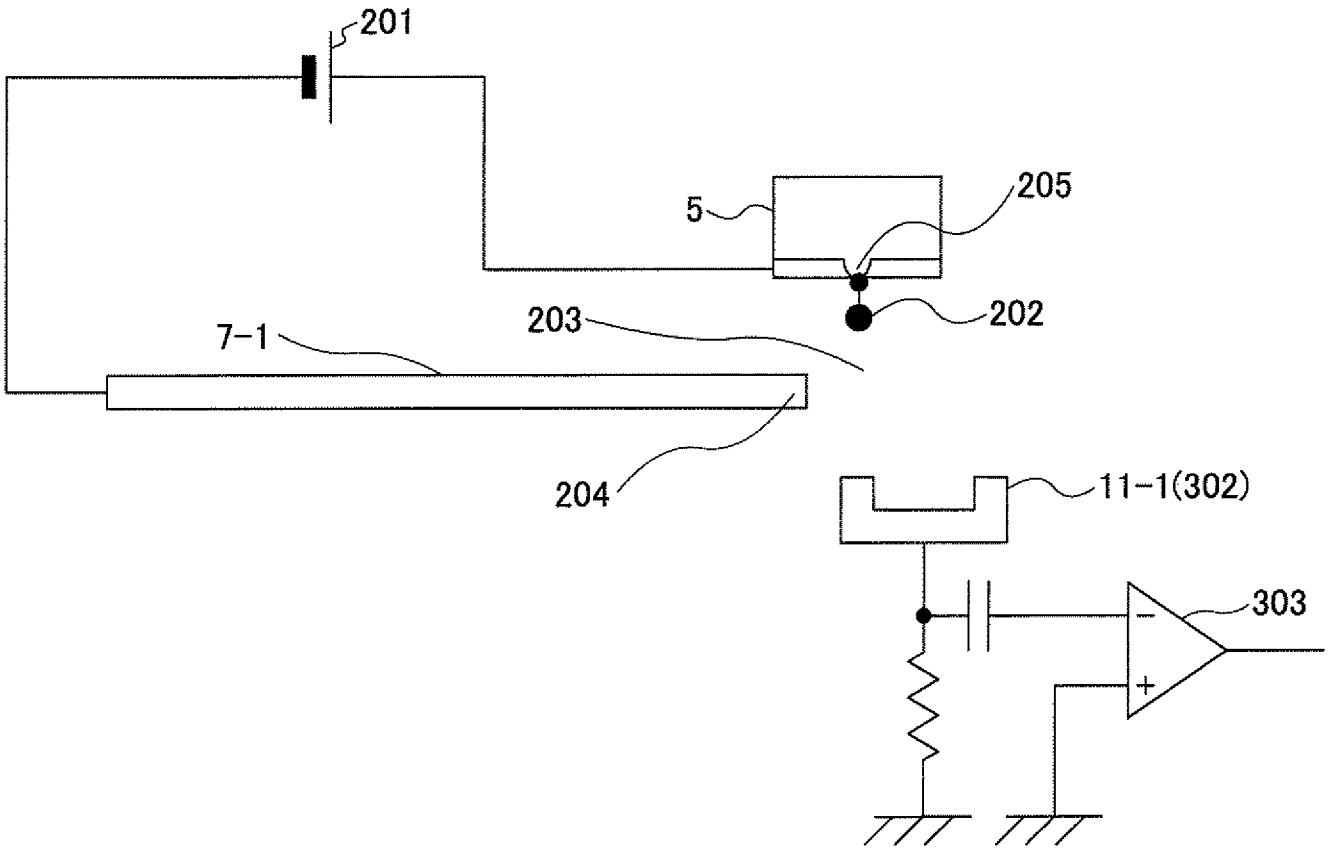
FIG. 4 shows a state of a part of the image forming apparatus of ink jet type according to the first mode for carrying out the present invention when a state of an ink droplet being discharged is checked (i.e., the nozzle discharge check operation is carried out) according to a first embodiment.
Figure 5:
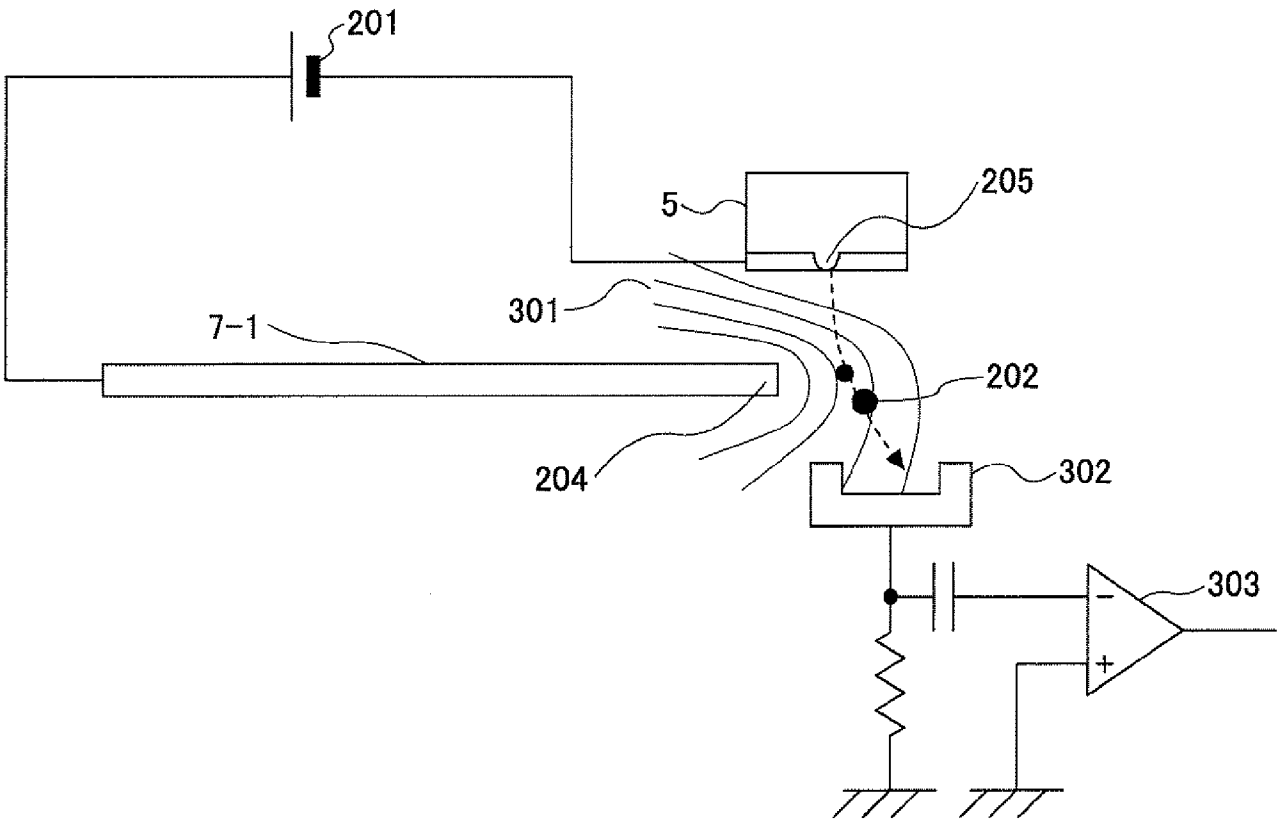
FIG. 5 illustrates the track of the liquid droplet flying through equipotential surfaces generated around an end part of an electrostatic attraction plate after the liquid droplet is discharged, when the state of the ink droplet being discharged is checked according to the first embodiment in the part of the image forming apparatus of ink jet type according to the first mode for carrying out the present invention.
Figure 6:
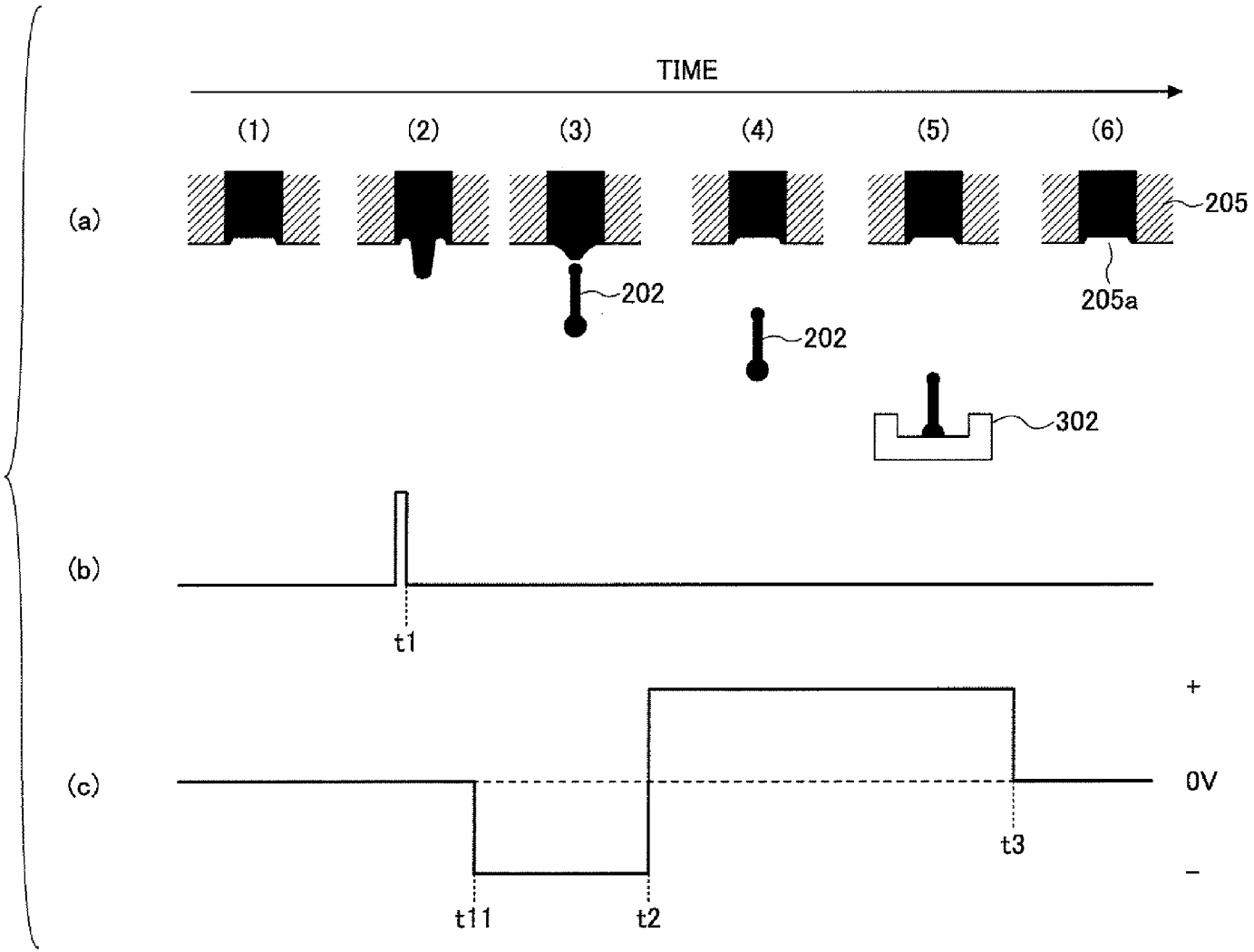
FIG. 6 (*a*) shows, with the passage of time, states (1) through (6) where a liquid droplet is discharged from a nozzle hole and then reaches a liquid droplet detecting electrode.

A first embodiment, i.e., a first operation example in the first mode for carrying out the present invention will now be described with reference to FIGS. 4, 5 and 6. FIGS. 4 and 5 diagrammatically show a front view of the part of the ink jet recording apparatus shown in FIG. 1, and show states in which the nozzle discharge check operation is carried out. FIG. 6 shows, with the passage of time, states (1) through (6) in which a liquid droplet 202 is discharged from a nozzle hole 205*a* of the ink jet head 5 (FIG. 6 (*a*)); a waveform of a liquid droplet discharge control signal provided by the control part 100 (FIG. 6 (*b*)); and a waveform of an electric potential of the electrostatic attraction plate 7-1 (electrostatic attraction member 7) with respect to the nozzle surface (i.e., the nozzle plate) of the ink jet head 5. It is noted that the passage of time corresponds to each other among FIGS. 6 (*a*), (*b*) and (*c*).

As shown in FIGS. 4 and 5, the high voltage generating source 201 (i.e., the high voltage generating source 8 of FIG. 1) is connected to both the electrostatic attraction plate 7-1 and the ink-jet head 5. At a time of the standby state shown in FIG. 6 (*a*) (1), under the control of the control part 100, the voltage is applied by the high voltage generating source 201 such that the electric potentials at the ink jet head 5 and the electrostatic attraction plate 7-1 are made equal to one another. Then, as a result of the liquid droplet control signal as a pulse at a time t1 being provided by the control part 100 to the carriage 1, as shown in FIG. 6 (*b*), discharging of the liquid droplet 202 is started, as shown in the state (2) of FIG. 6 (*a*). Then, at least at the moment the liquid droplet 202 is separating from the nozzle hole 205*a* of the nozzle 205 of the ink jet head 5, as shown in FIG. 6 (*a*) (3), the voltages are applied by the high voltage generating source 201, as shown in FIG. 4, such that the electric potential at the electrostatic attraction plate 7-1 becomes lower than the electric potential at the ink jet head 5 at a time t11 as shown in FIG. 6 (*c*). As a result, since the electric potential right below (i.e., a position 203 of FIG. 4) the ink jet head 5 becomes lower than the electric potential at the ink jet head 5, flying of the liquid droplet 202 is started in a condition in which a positive electric charge is stored by the liquid droplet 202. Next, as shown in FIG. 5, the voltages are applied by the high voltage generating source 201 such that the electric potential at the electrostatic attraction plate 7-1 becomes higher than the electric potential at the ink jet head 5 as shown in FIG. 6 (*c*), time t2, while, as shown in FIG. 6 (*a*) (4), the liquid droplet 202 is flying (i.e., after the liquid droplet 202 has been discharged from the ink jet head 5 until arriving at the liquid droplet detecting electrode 302). Then, after the liquid droplet 202 has landed on the liquid droplet detecting electrode 302 as shown in FIG. 6 (*a*) (5), the standby state shown in FIG. 6 (*a*) (6) occurs, and, as shown in FIG. 6 (*c*), the voltage is applied by the high voltage generating source 201 at a time t3 such that the electric potential at the electrostatic attraction plate 7-1 becomes equal to the electric potential at the ink jet head 5. In the first embodiment, it is preferable that the electric potential at the electrostatic attraction plate 7-1 is inverted at the moment the ink liquid is separating from the ink jet head 5 and becomes the liquid droplet 202 as shown in FIG. 6 (*a*) (3). According to the first embodiment, it is possible that the timing t1 (at which the ink jet head 5 is driven by the liquid droplet discharge control signal provided by the control part 100 to discharge the liquid droplet 202), the timing t11 (at which the electric potential at the electrostatic attraction plate 7-1 becomes lower than the electric potential at the ink jet head 5) and the timing t2 (at which the electric potential at the electrostatic attraction plate 7-1 is inverted) shown in FIG. 6 (*c*) are synchronized or have predetermined timing relationship with each other appropriately as described above. A synchronization part (i.e., the control part 100) which causes the timing t1, the timing t11 and the timing t2 to be synchronized or have the predetermined timing relationship with each other appropriately as described above may be provided in the first embodiment. Thus, according to the first embodiment, the high voltage generating source 201 under the control of the control part 100 controls the voltages applied to the ink jet head 5 and the electrostatic attraction plate 7-1 so that the polarity relationship between the electric potentials at the ink jet head 5 and an end part 204 of the electrostatic attraction plate 7-1 has the polarity relationship shown in FIG. 4 at the moment when the liquid droplet 202 is separating from the ink jet head 5; and the polarity relationship between the electric potentials at the ink jet head 5 and the end part 204 of the electrostatic attraction plate 7-1 has the polarity relationship shown in FIG. 5 during which the liquid droplet 202 is flying from the ink jet head 5 to the liquid droplet detecting electrode 302. Thus, according to the first embodiment, the high voltage generating source 201 (or 8), for originally applying the voltage to the electrostatic attraction plate 7-1 for being able to attract the sheet recording medium 6 on which an image is formed (recorded), may be used as a voltage applying part for inverting the polarities of or controlling the relationship between the electric potentials at the ink jet head 5 and the end part 204 of the electrostatic attraction plate 7-1.

However, it is also possible that instead of the above-described configuration of the synchronization part, a sensor part may be provided which can trace and determine the state of the liquid droplet 202 being discharged from the ink jet head 5. As a specific configuration of the sensor part, an example of a configuration including a light emitting diode (LED) and a light receiving device may be used. Preferably, plural light emitting diodes (LEDs) are disposed such that mutually parallel light beams are emitted, and one or plural sensors are provided to form a line as the light receiving device to receive the mutually parallel light beams. In this case, the synchronization part generates a synchronization signal based on the detection result of the sensor part to control the high voltage generating source 201 so that, in synchronization with the synchronization signal or according to predetermined timing relationship with the synchronization signal, at least the polarities of the high voltage generating source 201 are inverted between the time when the liquid droplet 202 is separating from the nozzle hole 205*a* of the nozzle 205 of the ink jet head 5 and the time period during which the liquid droplet 202 is flying from the nozzle hole 205*a* to the liquid droplet detecting electrode 302, as shown in FIG. 6.

According to the first embodiment, as shown in FIGS. 4 and 5, for the purpose of preventing the electrostatic attraction plate 7-1 and the end part 204 thereof from being positioned at a position right below (i.e., the position 203 of FIG. 4) the nozzle hole 205*a* of the nozzle 205 of the respective nozzles of the ink jet head 5 to be checked as to whether to properly discharge the liquid droplet, the electrostatic attraction plate 7-1 and the end part 204 thereof are disposed other than the right below position. The position at which the ink jet head 5 is positioned to achieve this position relationship is the discharge check position at which discharge of a liquid droplet is checked (i.e., the nozzle discharge check operation is carried out). By this configuration, as shown in FIG. 5, the distorted equipotential surfaces 301 are generated by the electric potentials at the end part 204 of the electrostatic attraction plate 7-1 and the ink jet head 5. The liquid droplet 202 is subject to Coulomb force generated by the equipotential surfaces 301 to fly in a direction from top left to bottom right in FIG. 5. Thus, the flying direction of the liquid droplet 202 is bent toward a direction to go away from the electrostatic attraction plate 7-1. Thus, according to the first embodiment, such an electric field is generated by the electrostatic attraction plate 7-1 that the electrified ink discharged from the ink jet head 5 is away from the electrostatic attraction plate 7-1 by bending the flying track by means of the difference in electric potential (inverting the polarities) between the ink jet head 5 and the electrostatic attraction plate 7-1.

The liquid droplet 202, after that, lands on the liquid droplet detecting electrode 302. To the liquid droplet detecting electrode 302, an amplifier circuit 303 is connected. When the electric charge stored by the liquid droplet 202 having landed the liquid droplet detecting electrode 302 has flown to the liquid droplet detecting electrode 302, the amplifier circuit 303 amplifies a signal generated accordingly, and the amplified signal is input to a detector 150 (see FIG. 17). Thus, the control part 100 (see FIG. 17) detects that the liquid droplet 202 has been discharged by the nozzle 205.

It is noted that it may be sufficient that the nozzle surface of the ink jet head 5 is approximately a plane or a flat surface, and it is not necessary to provide a projection equal to or more than hundreds of μm near the nozzle hole 205. Further, it is not necessary that the electrified liquid droplet 202 directly lands on the liquid droplet detecting electrode 302. That is, an electric conductor may be disposed at a position at which the electrified liquid droplet 202 lands, which conductor is in contact with the liquid droplet detecting electrode 302. Thus, in effect, such a configuration may be sufficient that the electric charge stored by the liquid droplet 202 flows to the liquid droplet detecting electrode 302, and this is detected. Further, the electric potential is made equal between the electrostatic attraction plate 7-1 and the ink jet head 5 at the time of the standby state in the above description. However, what is important is the difference in electric potential of the electrostatic attraction plate 7-1 as shown in FIG. 6 (*c*) between at the time when the liquid droplet 202 is separating from the ink jet head 5 shown in FIG. 6 (*a*) (3) and the time period during which the liquid droplet 202 is flying shown in FIG. 6 (*a*) (4). Therefore, the other relationships of electric potentials between the electrostatic attraction plate 7-1 and the ink jet head 5 may be any relationships. It is noted that the end part 204 of the electrostatic attraction plate 7-1 is provided in such a manner of being approximately horizontal, and also, preferably as a straight line. Thus, the electrostatic attraction plate 7-1 shown in FIG. 5 extends in a direction perpendicular to the plane of the drawing of FIG. 5, and, on a section perpendicular to the direction in which the electrostatic attraction plate 7-1 extends, the equipotential surfaces 301 shown in FIG. 5 are the same as those shown in FIG. 5. Further, the respective nozzles of the ink jet head 5 are arranged in a direction parallel to the direction in which the end part 204 of the electrostatic attraction plate 7-1 extends. Therefore, corresponding to each nozzle of the respective nozzles of the ink jet head 5 arranged in this direction, the equipotential surfaces 301 are the same as those shown in FIG. 5. Therefore, a flying track of the liquid droplet discharged by each nozzle of the respective nozzles of the ink jet head 5 becomes approximately the same as each other. Therefore, by carrying out the nozzle discharge check operations successively from the nozzle at one end to the nozzle at the other end of the ink jet head 5 one by one along the direction in which the respective nozzles are arranged, data of each liquid droplet from the electric charge stored by the liquid droplet discharged by the nozzle is input to the control part 100 basically at equal time intervals in a time division manner. In the first embodiment, by analyzing the thus-input data of the respective liquid droplets of the respective nozzles of the ink jet head 5, the control part 100 can determine which nozzle of the respective nozzles of the ink jet head 5 each liquid droplet having landed on the liquid droplet detecting electrode 302 has been discharged from. Further, the control part 100 can determine which nozzle of the respective nozzles of the ink jet head 5 is blocked up and thus cannot discharge the liquid droplet. Further, depending on the circumstances, according to the first embodiment, the control part 100 may analyze the waveform or such of the input data, and, not only may determine the current states of the respective nozzles of the ink jet head 5 but also may estimate whether the nozzles of the ink jet head 5 will be blocked up in future. These points may also be applied to any one of the embodiments described below.

Second Embodiment

Second Operation Example in First Mode for Carrying Out the Intention

Figure 7:
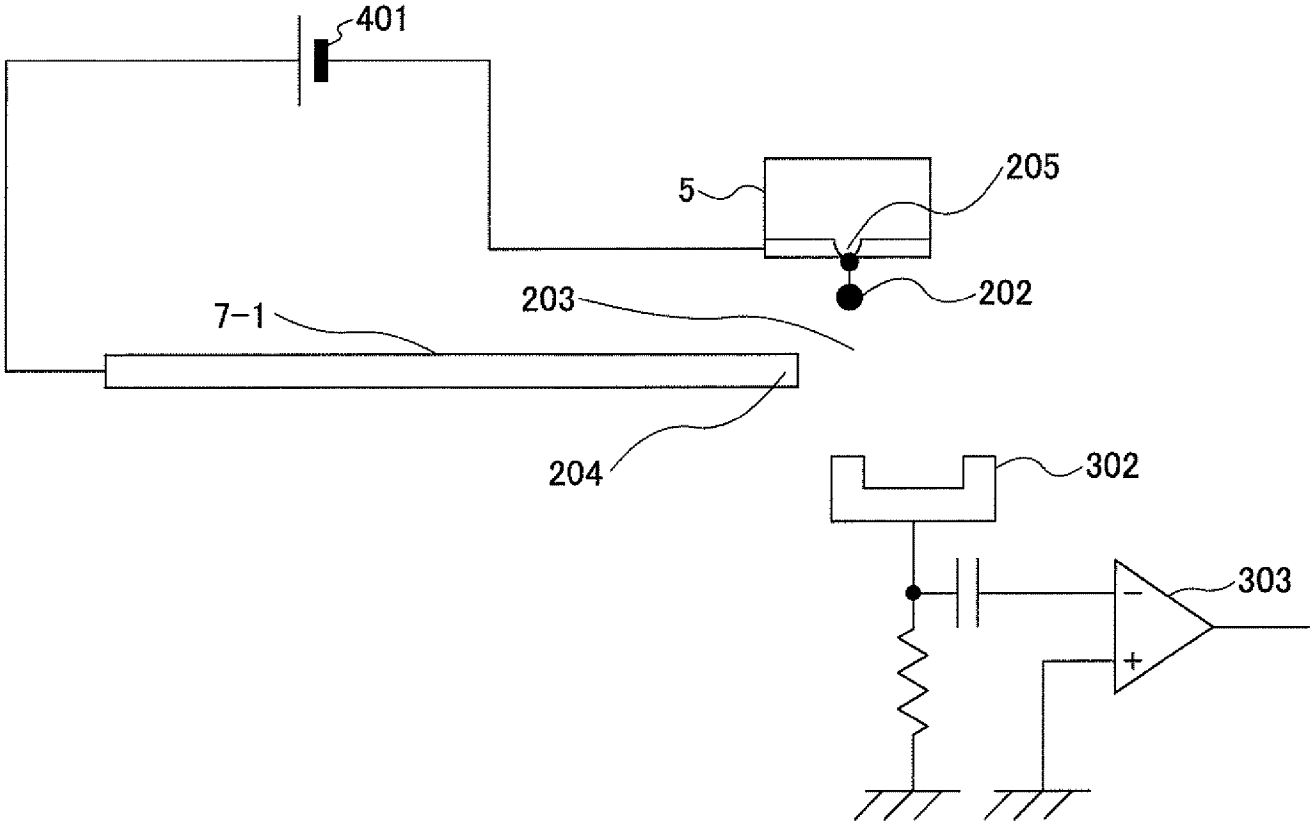
FIG. 7 shows a state of the part of the image forming apparatus of ink jet type according to the first mode for carrying out the present invention shown in FIG. 1, when the state of an ink droplet being discharged is checked according to a second embodiment.
Figure 8:
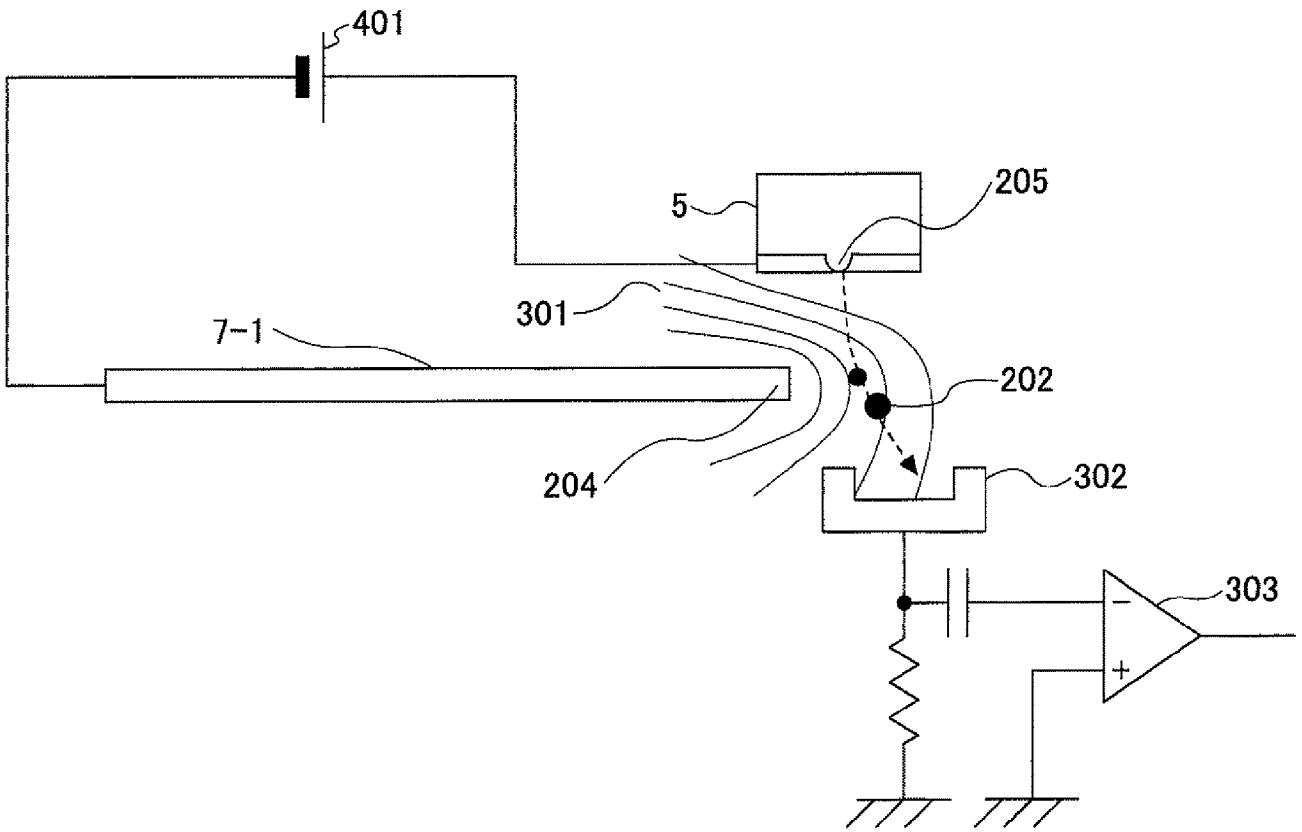
FIG. 8 illustrates the track of the liquid droplet flying through equipotential surfaces generated around the end part of the electrostatic attraction plate after the liquid droplet is discharged, when the state of the ink droplet being discharged is checked according to the second embodiment in the part of the image forming apparatus of ink jet type according to the first mode for carrying out the present invention.
Figure 9:
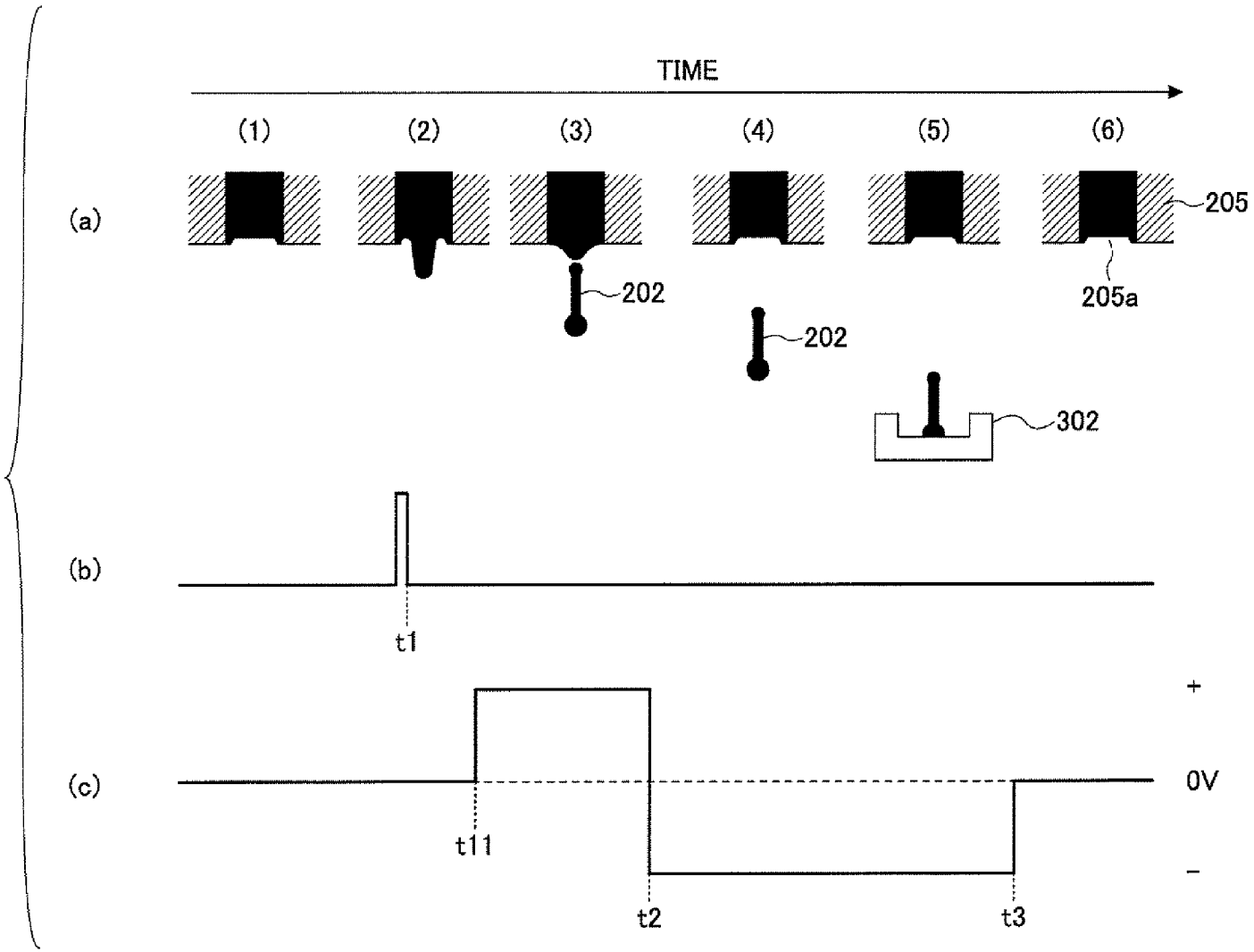
FIG. 9 (*a*) shows, with the passage of time, states (1) through (6) where the liquid droplet is discharged from the nozzle hole and then reaches the liquid droplet detecting electrode.

A second embodiment as a second operation example will now be described, with reference to FIGS. 7, 8 and 9. FIGS. 7 and 8 diagrammatically show a front view of the part of the ink jet recording apparatus shown in FIG. 1, and show a state of the nozzle discharge check operation being carried out. FIG. 9 corresponds to FIG. 6, and, the same as FIG. 6, the time corresponds to each other in the vertical direction of FIG. 9. A high voltage generating source 401 (i.e., the high voltage generating source 8 in FIG. 1) is connected to both the electrostatic attraction plate 7-1 and the ink-jet head 5. At a time of the standby state shown in FIG. 9 (*a*) (1), under the control of the control part 100, the voltage is applied by the high voltage generating source 401 such that the electric potentials at the ink jet head 5 and the electrostatic attraction plate 7-1 are made equal to one another. Then, as a result of the liquid droplet control signal as a pulse at a time t1 being provided by the control part 100 to the carriage 1, as shown in FIG. 9 (*b*), discharging of the liquid droplet 202 is started, as shown in the state (2) of FIG. 9 (*a*). Then, at least at the moment the liquid droplet 202 is separating from the nozzle hole 205*a* of the nozzle 205 of the ink jet head 5, as shown in FIG. 9 (*a*) (3), the voltages are applied by the high voltage generating source 201, as shown in FIG. 7, such that the electric potential at the electrostatic attraction plate 7-1 becomes higher than the electric potential at the ink jet head 5 at a time t11 as shown in FIG. 9 (*c*). As a result, since the electric potential right below (i.e., a position 203 of FIG. 7) the ink jet head 5 thus becomes higher than the electric potential at the ink jet head 5, flying of the liquid droplet 202 is started in a condition in which a negative electric charge is stored by the liquid droplet 202 (i.e., the liquid droplet 202 is negatively electrified). Next, as shown in FIG. 8, the voltage are applied by the high voltage generating source 201 such that the electric potential at the electrostatic attraction plate 7-1 becomes lower than the electric potential at the ink jet head 5 as shown in FIG. 9 (*c*), time t2, during a time period during which, as shown in FIG. 9 (*a*) (4), the liquid droplet 202 is flying (i.e., after the liquid droplet 202 has been discharged from the ink jet head 5 until arriving at the liquid droplet detecting electrode 302). Then, after the liquid droplet 202 lands on the liquid droplet detecting electrode 302 as shown in FIG. 9 (*a*) (5), the standby state shown in FIG. 9 (*a*) (6) occurs, and, as shown in FIG. 9 (*c*), the voltage is applied by the high voltage generating source 201 at a time t3 such that the electric potential at the electrostatic attraction plate 7-1 becomes equal to the electric potential at the ink jet head 5.

As shown in FIG. 7, the same as the first embodiment described above, in the second embodiment, for the purpose of preventing the electrostatic attraction plate 7-1 and the end part 204 thereof from being positioned at a position right below (i.e., the position 203 of FIG. 7) the nozzle hole 205*a* of the nozzle 205 of the respective nozzles of the ink jet head 5 to be checked as to whether to be able to properly discharge the liquid droplet, the electrostatic attraction plate 7-1 and the end part 204 thereof are disposed other than the right below position. The position at which the ink jet head 5 is positioned to achieve this positional relationship is the discharge check position at which discharge of the liquid droplet is checked (i.e., the nozzle discharge check operation is carried out). By this configuration, as shown in FIG. 8, the distorted equipotential surfaces 301 are generated the same as those shown in FIG. 5. The liquid droplet 202 receives Coulomb force generated by the electric field caused by the equipotential surfaces 301 to fly in a direction from top left to bottom right in FIG. 8. Thus, the flying direction of the liquid droplet 202 is bent toward a direction to go away from the electrostatic attraction plate 7-1.

The liquid droplet 202, after that, lands on the liquid droplet detecting electrode 302. To the liquid droplet detecting electrode 302, an amplifier circuit 303 (operational amplifier) is connected. When the electric charge stored by the liquid droplet 202 having landed on the liquid droplet detecting electrode 302 has flown to the liquid droplet detecting electrode 302, the amplifier circuit 303 amplifies a signal generated accordingly, and the amplified signal is input to a detector 150 (see FIG. 17). Thus, the control part 100 (see FIG. 17) detects that the liquid droplet 202 has been discharged by the nozzle 205.

It is noted that it may be sufficient that the nozzle surface of the ink jet head 5 is approximately a plane or a flat surface, and it is not necessary to provide a projection equal to or more than hundreds of μm near the nozzle hole 205. Further, it is not necessary that the electrified liquid droplet 202 directly lands on the liquid droplet detecting electrode 302. That is, an electric conductor may be disposed at a position at which the electrified liquid droplet 202 lands, which conductor is in contact with the liquid droplet detecting electrode 302. Thus, in effect, such a configuration may be sufficient that the electric charge stored by the liquid droplet 202 flows to the liquid droplet detecting electrode 302. Further, the electric potential is made equal between the electrostatic attraction plate 7-1 and the ink jet head 5 at the time of the standby state in the above description. However, what is important is the difference in electric potential of the electrostatic attraction plate 7-1 as shown in FIG. 9 (*c*) between at the time the liquid droplet 202 is separating from the ink jet head 5 shown in FIG. 9 (*a*) (3) and during the time period during which the liquid droplet 202 is flying as shown in FIG. 9 (*a*) (4). Therefore, other than this point, the relationships of electric potentials between the electrostatic attraction plate 7-1 and the ink jet head 5 may be any relationships.

Third Embodiment

Third Operation Example in First Mode for Carrying Out the Intention

A third embodiment as a third operation example of the first mode for carrying out the present invention will now be described with reference to FIGS. 10, 11A and 11B.

Figure 10:
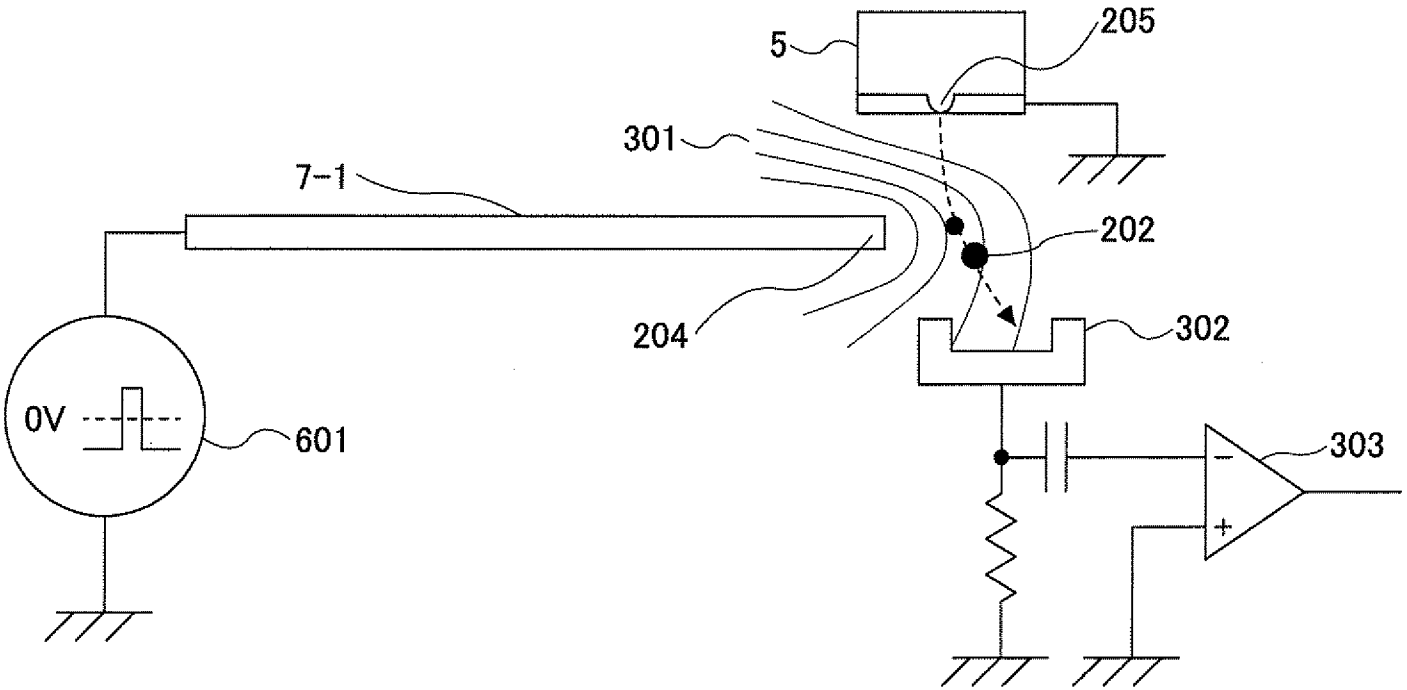
FIG. 10 illustrates the track of the liquid droplet flying through the equipotential surfaces generated around the end part of the electrostatic attraction plate after the liquid droplet is discharged, when the state of the ink droplet being discharged is checked according to a third embodiment in the part of the image forming apparatus of ink jet type according to the first mode for carrying out the present invention.

What is different from the above-described embodiments (operation examples) is that, as shown in FIG. 10, the ink jet head 5 is grounded, and a high voltage generating source 601 (i.e., the high voltage generating source 8 of FIG. 1) is connected only with the electrostatic attraction plate 7-1, and applies a voltage that varies from a minus voltage to a plus voltage to the electrostatic attraction plate 7-1. FIG. 11A is the same as FIG. 6 except that FIG. 11A (*c*) shows the voltage to be applied to the electrostatic attraction plate 7-1.

Figure 11A:
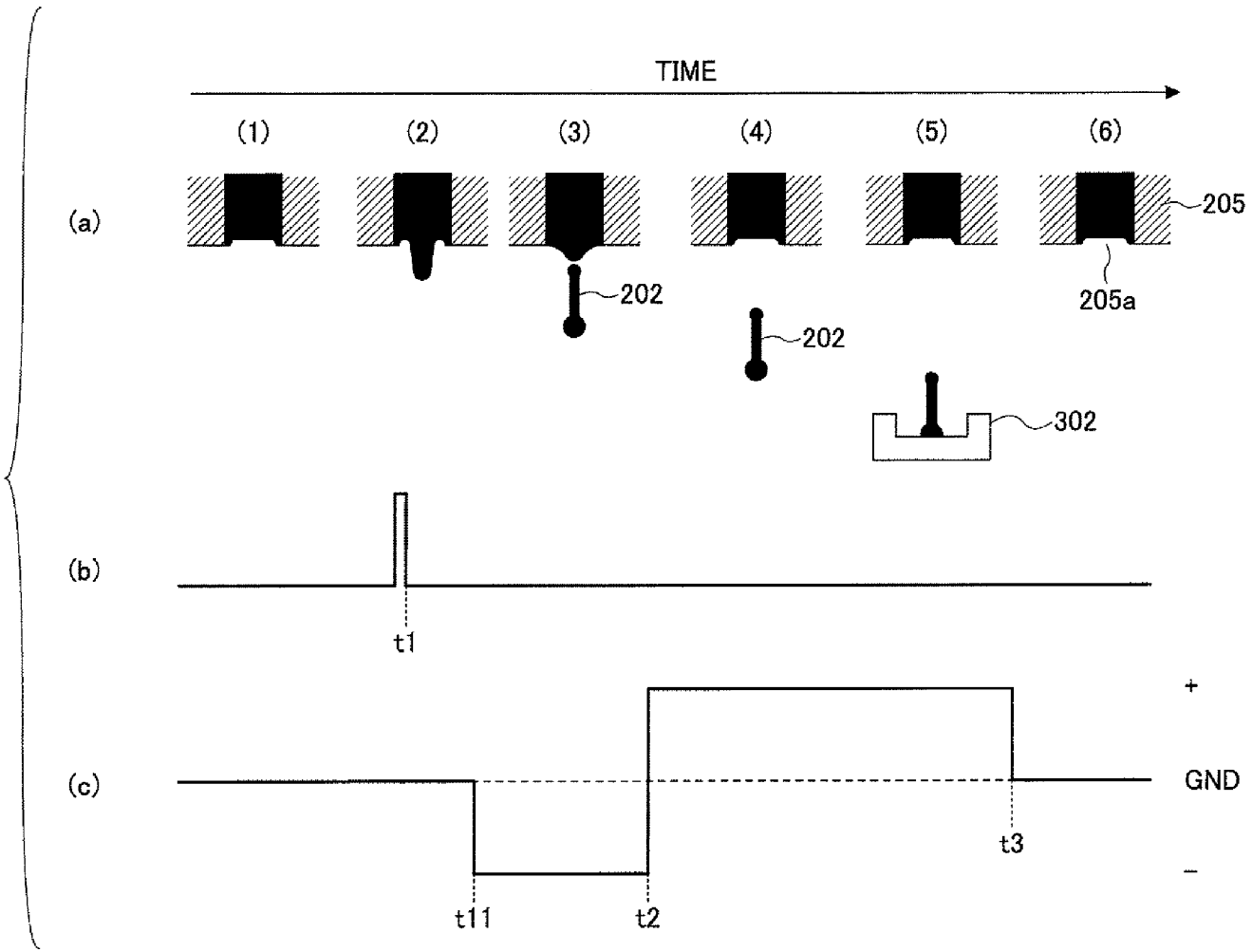
FIG. 11A (*a*) shows, with the passage of time, the states (1) through (6) where the liquid droplet is discharged from the nozzle hole and then reaches the liquid droplet detecting electrode.

At a time of the standby state shown in FIG. 11A (*a*) (1), the high voltage generating source 601 applies 0 V to the electrostatic attraction plate 7-1. Then, when the liquid droplet discharge control signal is output by the control part 100 to the carriage 1, as shown in FIG. 11A (*a*) (2), discharging of the liquid droplet 202 is started. At least at the moment the liquid droplet 202 is separating from the ink jet head 5 as shown in FIG. 11A (*a*) (3), the high voltage generating source 601 applies a minus voltage to the electrostatic attraction plate 7-1. Further, during a time period during which the liquid droplet 202 is flying as shown in FIG. 11A (*a*) (4), the high voltage generating source 601 applies a plus voltage to the electrostatic attraction plate 7-1. After the liquid droplet 202 lands on the liquid droplet detecting electrode 302 (i.e., the detecting part 11 of FIG. 1) as shown in FIG. 11A (*a*) (5), the standby state shown in FIG. 11A (*a*) (6) occurs, and the high voltage generating source 601 applies 0 V to the electrostatic attraction plate 7-1. By this configuration, it is possible to obtain the functions the same as those of the first embodiment described above.

Figure 11B:
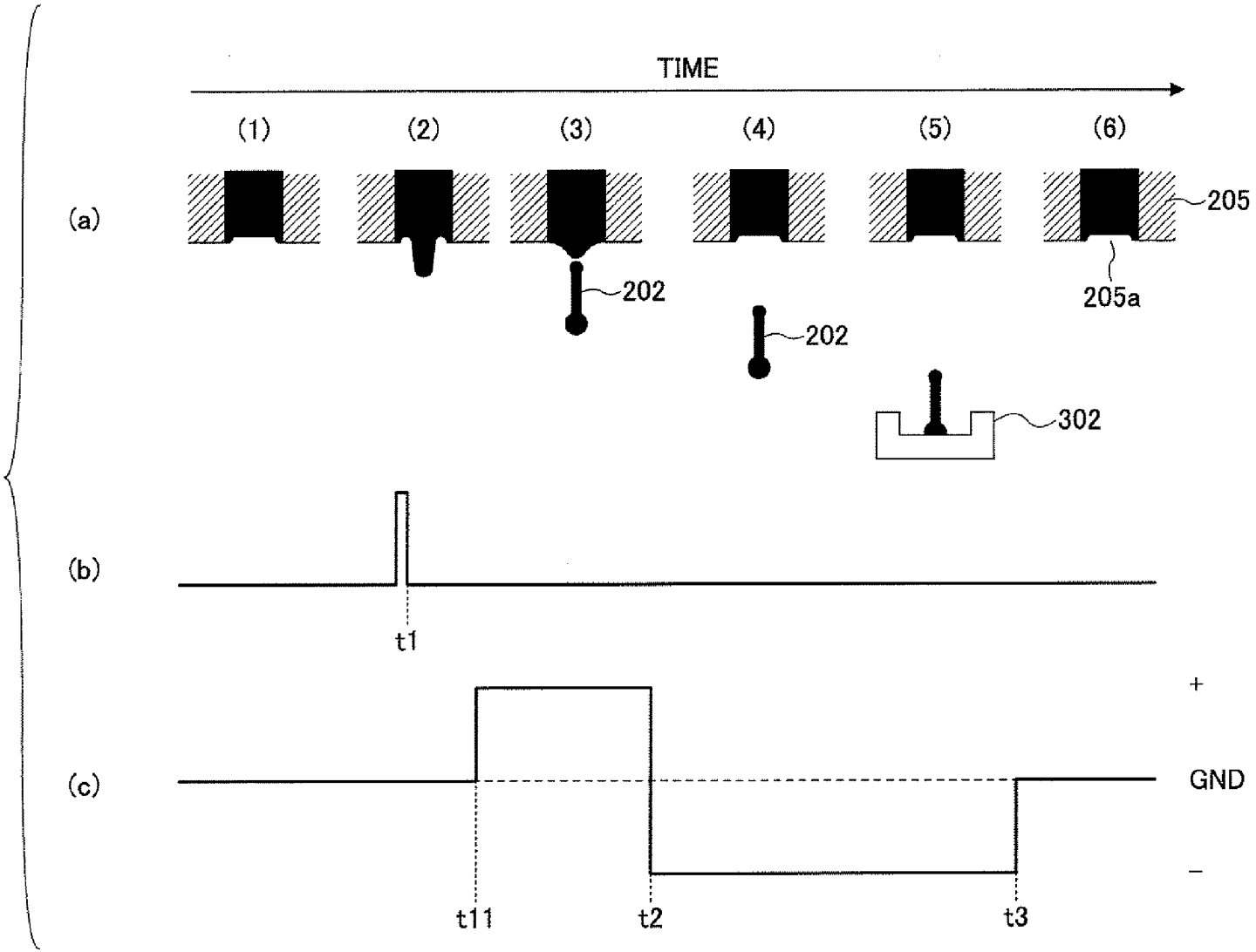
FIG. 11B (*a*) shows, with the passage of time, the states (1) through (6) where the liquid droplet is discharged from the nozzle hole and then reaches the liquid droplet detecting electrode.

Instead, at least at the moment the liquid droplet 202 is separating from the ink jet head 5, as shown in FIG. 11B (*a*) (3), the high voltage generating source 601 may apply a plus voltage to the electrostatic attraction plate 7-1; and, during a time period during which the liquid droplet 202 is flying as shown in FIG. 11B (1) (4), the high voltage generating source 601 may apply a minus voltage to the electrostatic attraction plate 7-1. By this configuration, it is possible to obtain the functions the same as those of the second embodiment described above.

It is noted that the example in which 0 V is applied to the electrostatic attraction plate 7-1 at the time of the standby state has been described. The same as the above, the difference in electric potential of the electrostatic attraction plate 7-1 between at the moment the liquid droplet 202 is separating from the ink jet head 5 (shown in FIG. 11A (*a*) (3)) and during the time period during which the liquid droplet 202 is flying (shown in FIG. 11A (*a*) (4)) is important. Therefore, other than this point, the same as the above, the electric potential at the electrostatic attraction plate 7-1 may be any electric potential.

Fourth Embodiment

Fourth Operation Example in First Mode for Carrying Out the Intention

Figure 12:
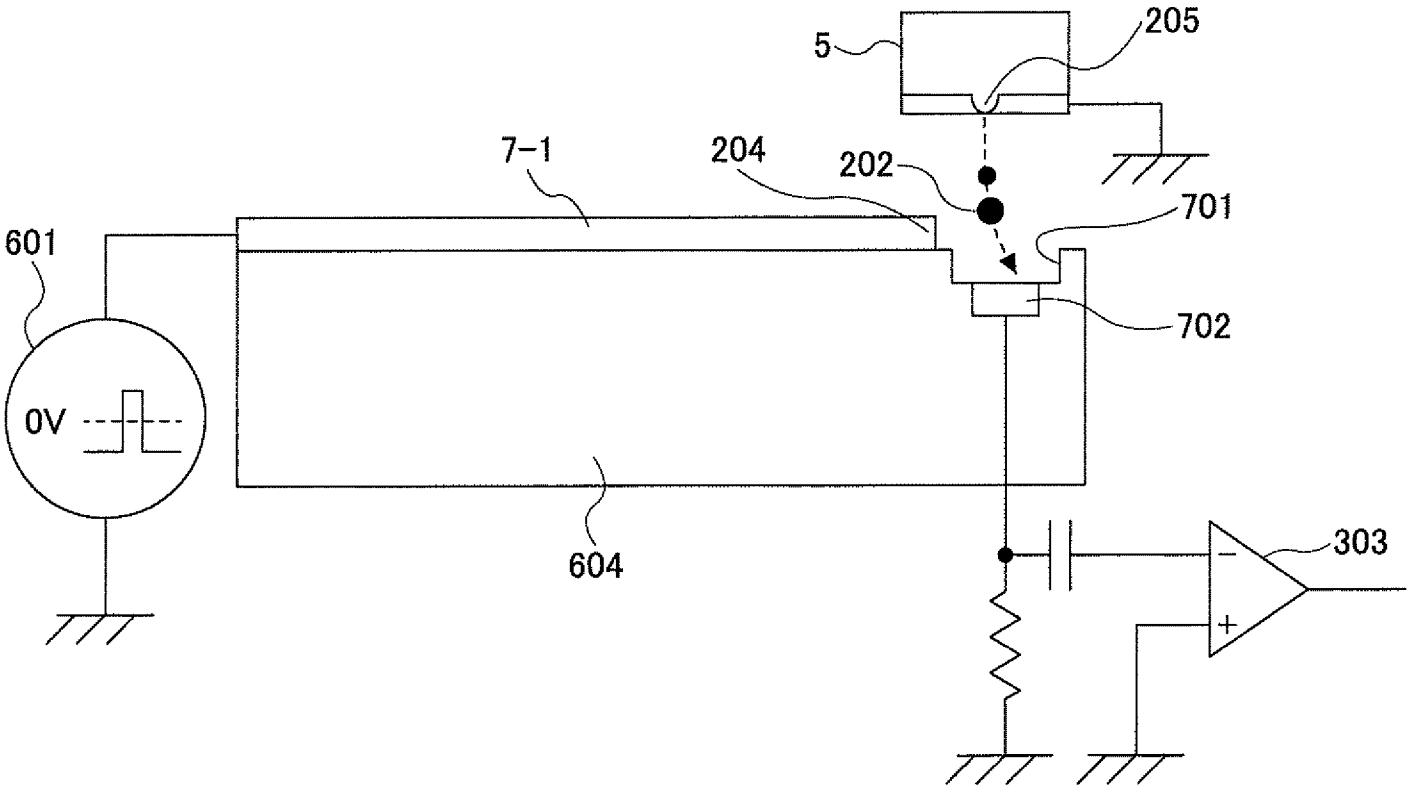
FIG. 12 shows a state of the part of the image forming apparatus of ink jet type according to the first mode for carrying out the present invention, when a state of an ink droplet being discharged is checked according to a fourth embodiment.

A fourth embodiment as a fourth operation example of the first mode for carrying out the present invention will now be described with reference to FIG. 12.

In the fourth embodiment, on a frame 604 that supports the electrostatic attraction plate 7-1, a liquid droplet receiving part 701 is provided at a position not under the electrostatic attraction plate 7-1 and off the electrostatic attraction plate 7-1, and near the electrostatic attraction plate 7-1. A liquid droplet detecting electrode 702, corresponding to the liquid droplet detecting electrode 302 mentioned above, is provided in the liquid droplet receiving part 701. By this configuration, the electrostatic attraction plate 7-1 is not likely to be stained by the liquid droplet 202 even though the flying direction of the liquid droplet 202 is not greatly bent, and therefore, it is possible to reduce a voltage to be applied to the electrostatic attraction plate 7-1 or the ink jet head 5. Thereby, a margin of design increases.

The liquid droplet receiving part 701 may be one in which a depression is formed or may be one in which a porous liquid absorption member is installed.

Fifth Embodiment

First Embodiment of Second Mode for Carrying Out the Intention

A fifth embodiment (i.e., a first embodiment of a second mode for carrying out the present invention) of the present invention will now be described with reference to FIGS. 13, 14A and 14B.

Figure 13:
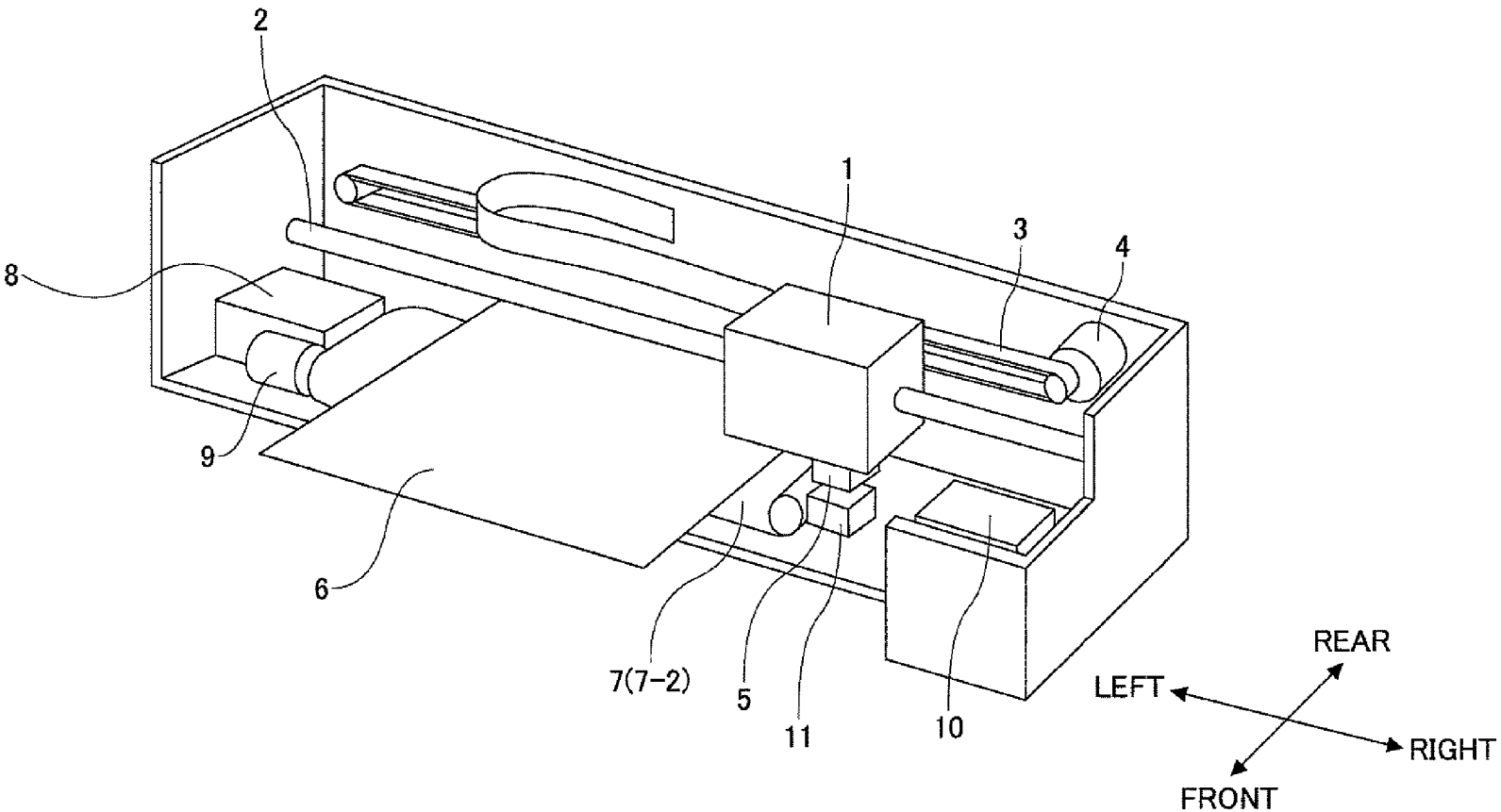
FIG. 13 shows a perspective view of a partial configuration of an image forming apparatus of ink jet type according the second mode for carrying out the present invention.

According to the fifth embodiment, an ink jet recording apparatus shown in FIG. 13 is used.

The fifth embodiment belongs to the second mode for carrying out the present invention. The second mode for carrying out the present invention is different from the above-described first mode for carrying out the present invention shown in FIG. 1 in that, as the electrostatic attraction member 7, an electrostatic attraction belt 7-2 is provided. To the electrostatic attraction belt 7-2, an alternate current voltage of hundreds through thousands of volts which varies between positive and negative voltages is applied by a high voltage generating source 8 for generating electrostatic force. The electrostatic attraction belt 7-2 conveys a sheet recording medium 6 in a forward direction (FRONT in FIG. 1) as the motor 9 moves (drives) the electrostatic attraction belt 7-2 while the electrostatic attraction belt 7-2 attracts the sheet recording medium 6 by means of the electrostatic force. The voltage applied by the high voltage generating source 8 to the electrostatic attraction belt 7-2 is controlled by the control part 100 (see FIG. 17).

Liquid droplets are caused to be discharged from the ink jet head 5 toward the sheet recording medium 6 according to image data sent from the control part 100 while the carriage 1 is moved in the left direction, and the sheet recording medium 6 is moved in the forward direction by a predetermined distance. After that, liquid droplets are caused to be discharged from the ink jet head 5 toward the sheet recording medium 6 according to image data sent from the control part while, at this time, the carriage 1 is moved in the right direction. By repeating the operations, a desired image is formed (recorded) on one side of the sheet recording medium 6.

The carriage 1 and so forth are the same as those in the first mode for carrying out the present invention.

A state of applying voltages to the electrostatic attraction belt 7-2 will now be described with reference to FIGS. 14A and 14B. As shown in FIGS. 14A and 14B, the electrostatic attraction belt 7-2 is wound on and between conveyance rollers 802, and is rotated as a result of at least one of the conveyance rollers 802 being driven by the motor 9. Further, the electrostatic attraction belt 7-2 is rotated in contact with an electrification roller 804 to which an alternate current voltage is applied by a high voltage generating source 803 (i.e., the high voltage generating source 8 in FIG. 13). Thereby, a positive charge and a negative charge are given to the electrostatic attraction belt 7-2 alternately, and thus, on the electrostatic attraction belt 7-2, positively electrified areas (indicated by "+" in FIGS. 14A and 14B) and negatively electrified areas (indicated by "−" in FIGS. 14A and 14B) are formed alternately along a direction of the electrostatic attraction belt 7-2 being moved, as shown in FIGS. 14A and 14B.

Figure 14A:
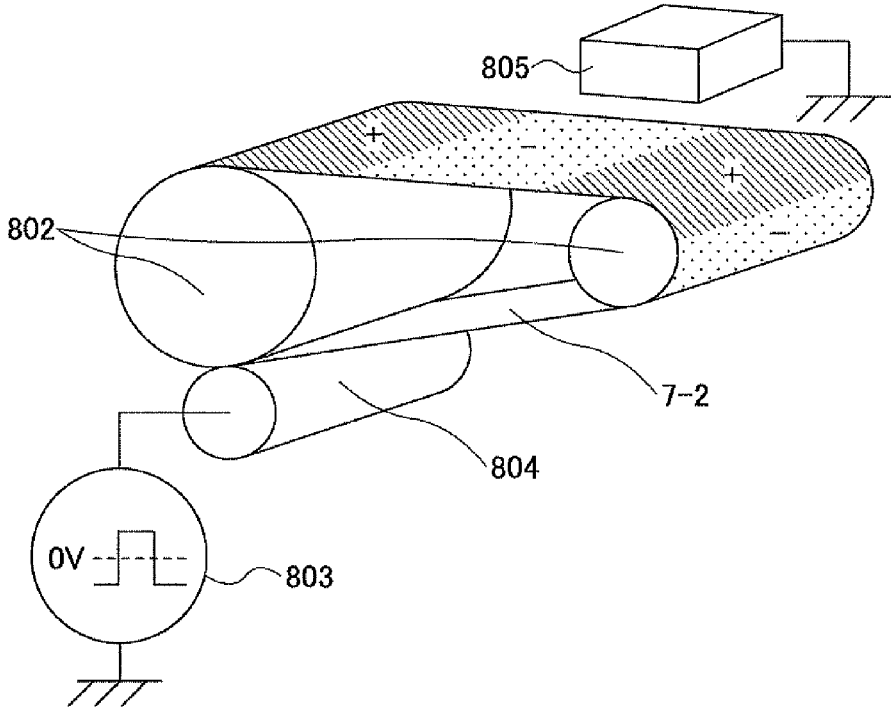
FIGS. 14A and 14B illustrate states of a voltage being applied to an electrostatic attraction belt in a case where the electrostatic attraction belt is used as the electrostatic attraction member in the fifth embodiment in the image forming apparatus of ink jet type according to the second mode for carrying out the present invention.

When the nozzle discharge check operation is carried out in the fifth embodiment, at the moment a liquid droplet (not shown) is separating from the ink jet head 805 (i.e., the ink jet head 5 in FIG. 13), the area which has been negatively electrified is caused to be close to the ink jet head 805 as shown in FIG. 14A. Then, after the liquid droplet starts flying after separating from the ink jet head 805, the electrostatic attraction belt 7-2 is slightly moved forward, and thus, the area which has been positively electrified is caused to be close to the ink jet head 805 as shown in FIG. 14B. Then, during a time period during which the liquid droplet is flying, the state in which the area which has been positively electrified is caused to be close to the ink jet head 805 as shown in FIG. 14B is maintained. By this configuration, it is possible to obtain the functions the same as those of the first embodiment described above with reference FIGS. 4, 5 and 6. At a time of the standby state, any areas of the electrostatic attraction belt 7-2 may be caused to be close to the ink jet head 805.

Figure 14B:
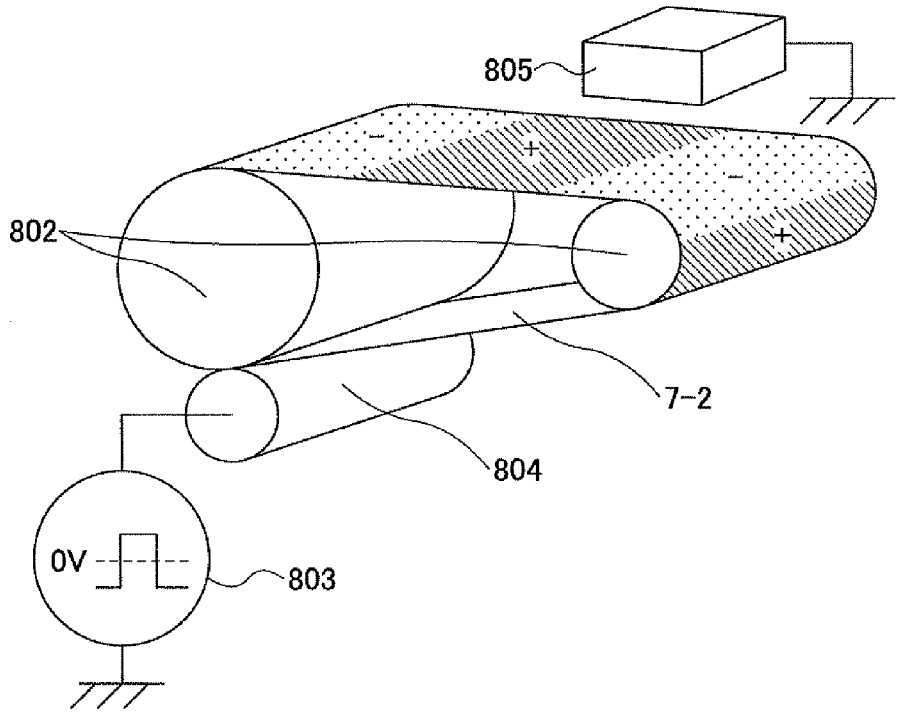

Instead, at the moment the liquid droplet is separating from the ink jet head 805, the area which has been positively electrified may be caused to be close to the ink jet head 805 as shown in FIG. 14B. Then, after the liquid droplet starts flying after separating from the ink jet head 805, the electrostatic attraction belt 7-2 may be slightly moved forward, and thus, the area which has been negatively electrified may be caused to be close to the ink jet head 805 as shown in FIG. 14A. Then, during a time period during which the liquid droplet is flying, a state in which the area which has been negatively electrified is caused to be close to the ink jet head 805 as shown in FIG. 14A may be maintained. By this configuration, it is possible to obtain the functions the same as those of the second embodiment described above with reference to FIGS. 7, 8 and 9. Also in the case, at a time of the standby state, any areas of the electrostatic attraction belt 7-2 may be caused to be close to the ink jet head 805. It is possible to provide a configuration such that by mounting an encoder or such to the electrostatic attraction belt 7-2, an amount of the electrostatic attraction belt 7-2 being moved can be determined by the control part 100 (see FIG. 17). By means of the encoder, the control part 100 can determine which areas of the electrostatic attraction belt 7-2 are those positively or negatively electrified. By using the information indicating which areas of the electrostatic attraction belt 7-2 are those positively or negatively electrified, the control part 100 determines the positively and negatively electrified areas of the electrostatic attraction belt 7-2 and thus can appropriately carry out the nozzle discharge check operation in the fifth embodiment described above with reference to FIGS. 14A and 14B.

Sixth Embodiment

Second Embodiment of Second Mode for Carrying Out the Intention

Figure 15A:
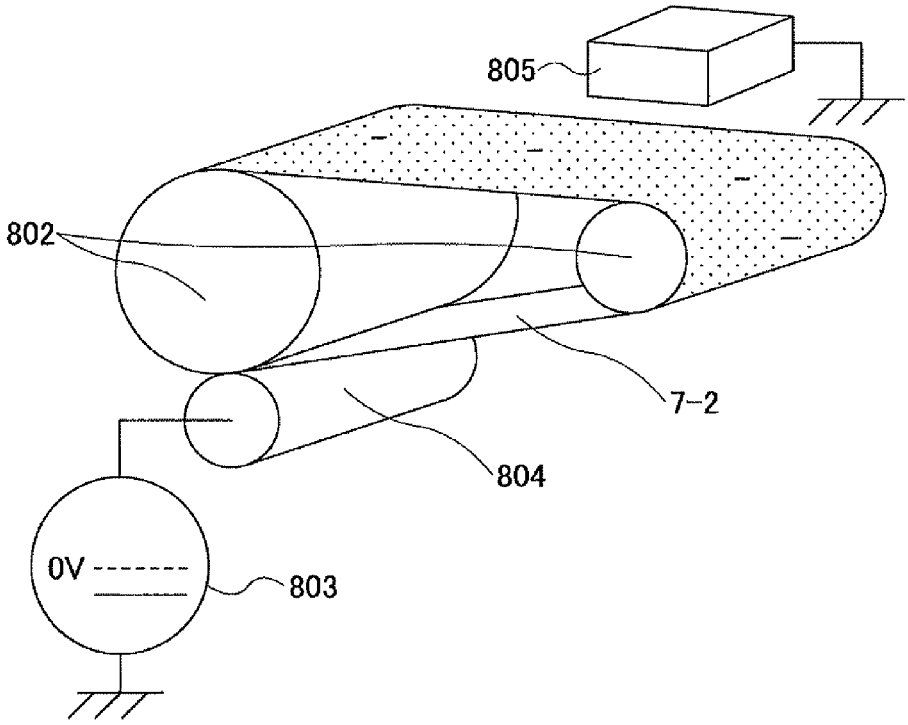
FIGS. 15A and 15B illustrate states of a voltage being applied to the electrostatic attraction belt in a case where the electrostatic attraction belt is used as the electrostatic attraction member in a sixth embodiment in the image forming apparatus of ink jet type according to the second mode for carrying out the present invention.
Figure 15B:
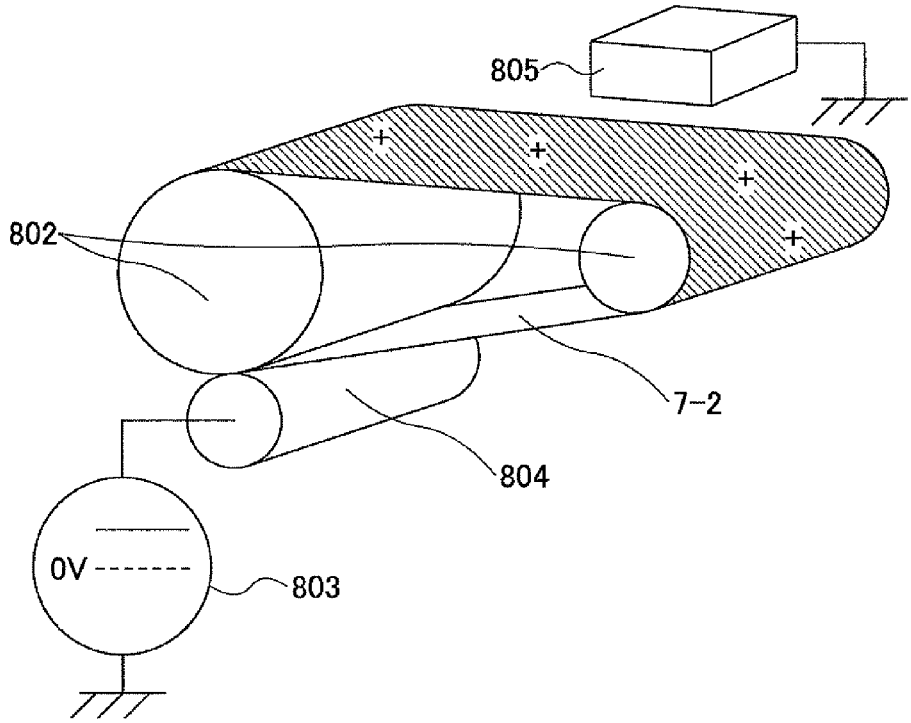

A sixth embodiment (i.e., a second embodiment of the second mode for carrying out the present invention) of the present invention will now be described with reference to FIGS. 15A and 15B. When the nozzle discharge check operation is to be carried out, at the moment a liquid droplet (not shown) is separating from the ink jet head 805, previously a negative direct current voltage is applied to the electrification roller 804 by a high voltage generating source 803 (i.e., the high voltage generating source 8 in FIG. 13), the electrostatic attraction belt 7-2 is moved by equal to or more than full turn, and thus, all the area of the electrostatic attraction belt 7-2 is negatively electrified (indicated by "−" in FIG. 15A) as shown in FIG. 15A. Then, after the liquid droplet starts flying after separating from the ink jet head 805, a positive direct current voltage is applied to the electrification roller 804 by the high voltage generating source 803, the electrostatic attraction belt 7-2 is moved by equal to or more than full turn, and thus, all the area of the electrostatic attraction belt 7-2 is positively electrified (indicated by "+" in FIG. 15B) as shown in FIG. 15B. By this configuration, it is possible to obtain the functions the same as those of the first embodiment described above with reference to FIGS. 4, 5 and 6.

Instead, at the moment a liquid droplet is separating from the ink jet head 805, previously a positive direct current voltage may be applied to the electrification roller 804 by the high voltage generating source 803, the electrostatic attraction belt 7-2 may be moved by equal to or more than full turn and thus, all the area of the electrostatic attraction belt 7-2 may be positively electrified as shown in FIG. 15B. Then, after the liquid droplet starts flying after separating from the ink jet head 805, a negative direct current voltage may be applied to the electrification roller 804 by the high voltage generating source 803, the electrostatic attraction belt 7-2 may be moved by equal to or more than full turn, and thus, all the area of the electrostatic attraction belt 7-2 may be negatively electrified as shown in FIG. 15A. By this configuration, it is possible to obtain the functions the same as those of the second embodiment described above with reference to FIGS. 7, 8 and 9.

Thus, the cases where the high voltages are applied to the electrostatic attraction plate 7-1 and the cases where the high voltages are applied to the electrostatic attraction belt 7-2 have been described as the corresponding examples have been taken. According to embodiments of the present invention, it is sufficient that the electrostatic attraction member 7 for attracting and conveying the sheet recording medium 6 is provided, and the polarity of the electrostatic attraction member 7 can be controlled. For example, such a configuration may be applied to an embodiment of the present invention that below a conveyance belt for conveying a sheet recording medium 6 such as paper, the electrostatic attraction plate 7-1 is provided, and the high voltages are applied to the electrostatic attraction plate 7-1.

Further, in the above-mentioned examples (embodiments), the flow of the electric charge stored in the liquid droplet 202 to the liquid droplet detecting electrode 302 is detected. However, as long as it is possible to detect the liquid droplet discharged by the ink jet head 5 as a result of the liquid droplet being electrified, any other method may be applied to an embodiment of the present invention. For example, a method discussed in Japanese Laid-Open Patent Application No. 2006-272634 (the Patent Document 3) that a liquid droplet being discharged is electrified, and an induced current generated when the liquid droplet is passing near a detection electrode is detected may be applied (especially, see FIGS. 9 and 18 of the Patent Document 3).

Figure 16A:
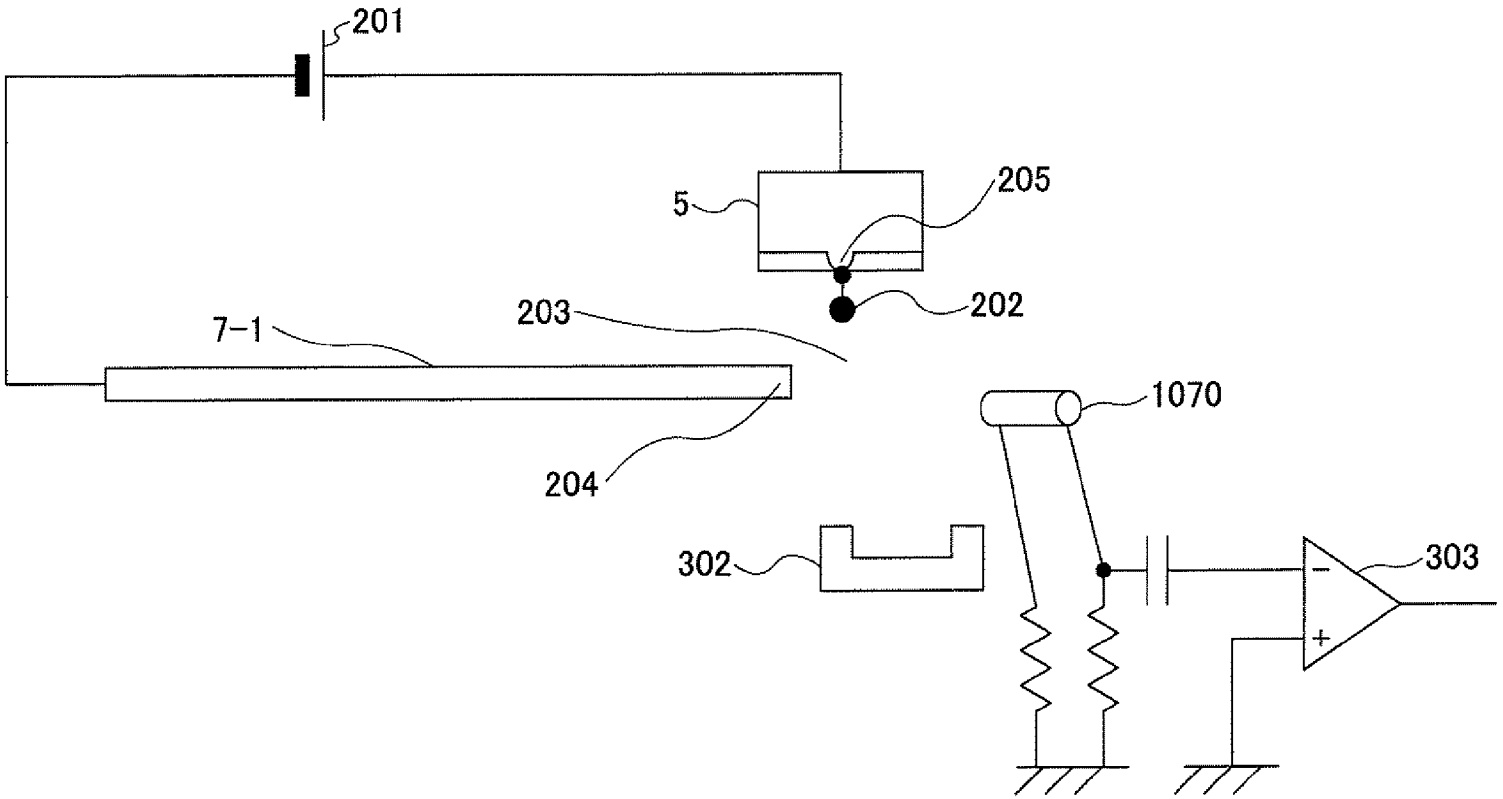
FIG. 16A shows one example of an alternative configuration for detecting a liquid droplet by detecting an induced electric current.
Figure 16B:
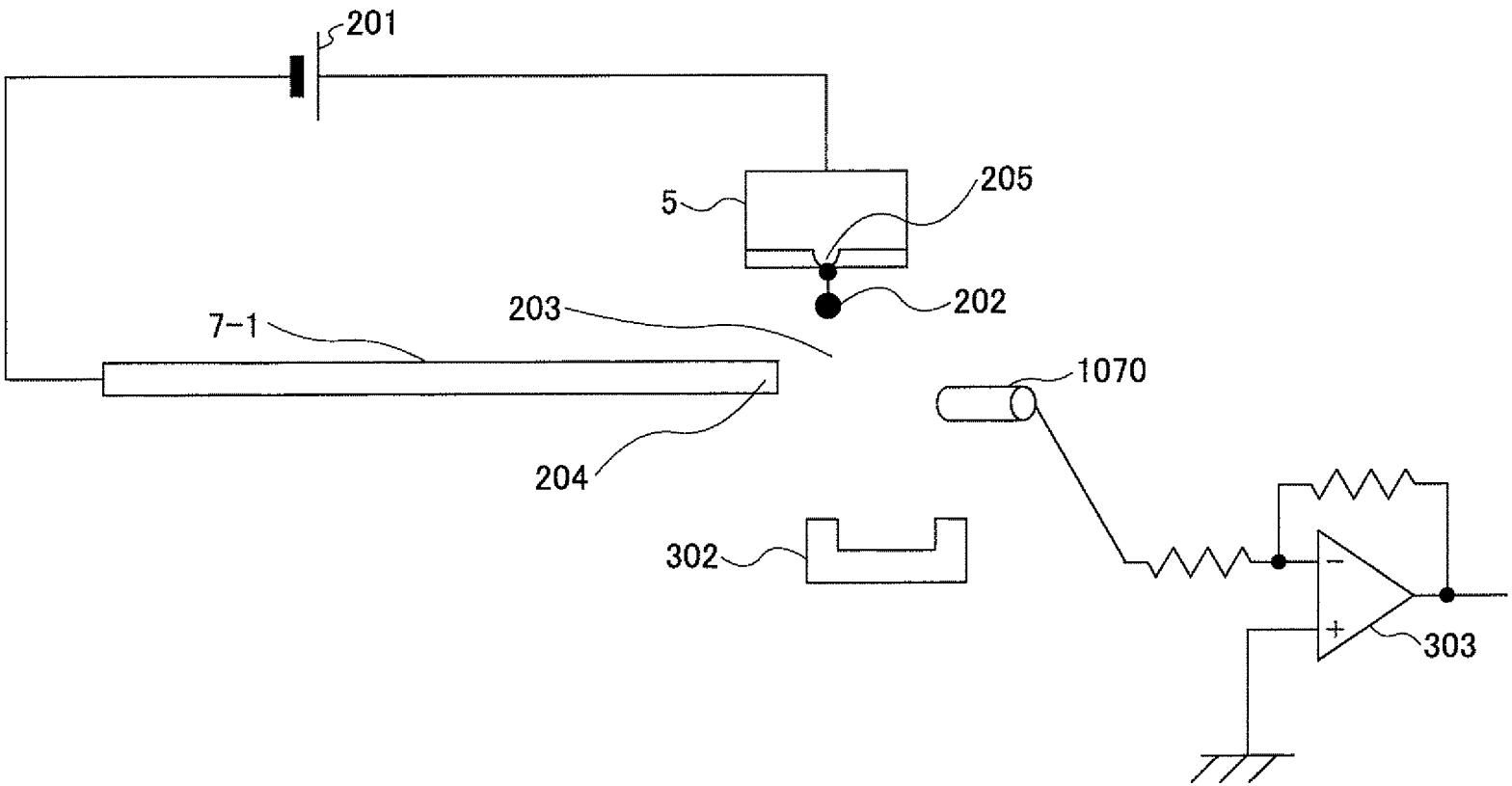
FIG. 16B shows another example of the alternative configuration for detecting a liquid droplet by detecting an induced electric current.

Examples of a method of detecting the induced current will now be descried. As shown in FIG. 16A or FIG. 16B, a conductor 1070 may be provided. In the configuration, when a liquid droplet 202 discharged from the ink jet head 5 and electrified by an electric field generated between the ink jet head 5 and the electrostatic attraction plate 7-1 passes near the conductor 1070, an induced current flows through the conductor 1070. Therefore, by amplifying the signal of the induced current with an amplifier circuit (operational amplifier) 303, it is possible to detect that the liquid droplet 202 has passed near the conductor 1070. It is noted that, except for the above-described configuration, the configuration shown in each of FIG. 16A and FIG. 16B is the same as the configuration of FIG. 4, for example, the same reference numerals are given to the parts/components that are identical or corresponding to those of the configuration of FIG. 4, for example, and duplicate description thereof is omitted.

Figure 17:
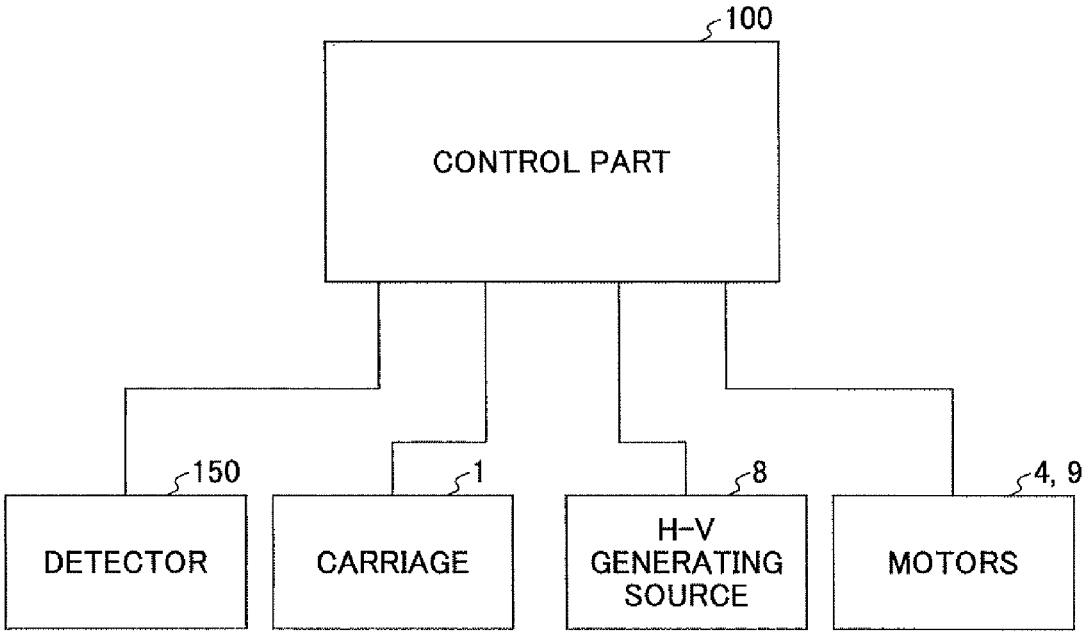
FIG. 17 shows an example of a control system of the ink jet recording apparatus according to any one of the embodiments of the present invention.

FIG. 17 shows an example of a control system of each of the embodiments described above. As shown in FIG. 17, the control part 100 (for example, made of a computer) is connected to the detector 150, the carriage 1, the have voltage generating source 8, the motors 4 and 9, and so forth. The control part 100 may control the entirety of the ink jet recording apparatus according to any one of the embodiments described above, and carries out the operations of the embodiments described above with reference to FIGS. 1 through 16B.

Further, embodiments of the present invention are not limited to positional relationship of "right" and "left", and embodiments of the present invention may be applied to cases where the positional relationship is reversed.

The present invention is not limited to the specifically disclosed embodiments, and variations and modifications may be made without departing from the scope of the present invention.

The present application is based on Japanese priority application No. 2010-059019 filed Mar. 16, 2010, the entire contents of which are hereby incorporated herein by reference.

What is claimed is:

1. An image forming apparatus that forms an image on a sheet by discharging a liquid droplet from a nozzle hole in a recording head to the sheet, comprising:

a voltage applying part that applies a voltage to an electrostatic attraction member to cause the electrostatic attraction member to attract the sheet, and acts as an electrically charging part that causes the liquid droplet to be electrically charged; and a checking part that detects an electrical charge or an induced electric current of the liquid droplet that has been electrically charged, for checking a state of the liquid droplet being discharged from the nozzle hole, wherein an electric potential applied by the voltage applying part is different between at a time when the liquid droplet is separating from the nozzle hole and at a time when the liquid droplet is flying, and wherein the checking part is placed at a position laterally outside, and near, the electrostatic attraction member, while facing the recording head at a time of checking the state of the liquid droplet being discharged from the nozzle hole, and at the time of checking the state of the liquid droplet being discharged from the nozzle hole, the nozzle hole in the recording head is placed at a position other than a position facing the electrostatic attraction member and also other than a position facing an end of the electrostatic attraction member, and an electric field is generated to cause a flying track of the liquid droplet to be bent by an electric potential between the recording head and the electrostatic attraction member, to carry the liquid droplet away from the electrostatic attraction member.

2. The image forming apparatus as claimed in claim 1, wherein the voltage applied by the voltage applying part to the electrostatic attraction member is changed in such a manner that a difference between the electric potential applied by the voltage applying part to the electrostatic attraction member when the liquid droplet is separating from the nozzle hole and the electric potential applied by the voltage applying part to the electrostatic attraction member when the liquid droplet is flying becomes larger.

3. The image forming apparatus as claimed in claim 1, wherein applying the voltage to the electrostatic attraction member by the voltage applying part is carried out in such a manner that polarity of the electric potential applied by the voltage applying part to the electrostatic attraction member when the liquid droplet is separating from the nozzle hole and polarity of the electric potential applied by the voltage applying part to the electrostatic attraction member when the liquid droplet is flying are different from one another.

4. The image forming apparatus as claimed in claim 1, wherein the electrostatic attraction member comprises an electrostatic attraction plate or an electrostatic attraction belt.

5. The image forming apparatus as claimed in claim 1, wherein the voltage applying part applies the voltage to the electrostatic attraction member, which voltage is one to be applied at the time when the liquid droplet is separating from the nozzle hole, in synchronization with timing at which the liquid droplet is discharged from the nozzle hole.

* * * * *